US005715669A

United States Patent [19]

Hasegawa et al.

[11] Patent Number: 5,715,669

[45] Date of Patent: Feb. 10, 1998

[54] BOBBIN TRANSPORTING SYSTEM FOR ROVING AND SPINNING MACHINES WITH APPARATUS TO EXCHANGE BOBBINS OF DIFFERING PITCHES

[75] Inventors: Toshinori Hasegawa; Kengo Ohashi; Takayuki Morita; Masuo Hayakawa, all of Kariya, Japan

[73] Assignee: Kabushiki Kaisha Toyoda Jidoshokki Seisakusho, Kariya, Japan

[21] Appl. No.: 563,632

[22] Filed: Nov. 28, 1995

[30] Foreign Application Priority Data

Nov. 30, 1994 [JP] Japan ..... 6-297381

[51] Int. Cl.[6] ..... D01H 9/18

[52] U.S. Cl. ..... 57/281; 57/267; 57/270

[58] Field of Search ..... 57/281, 90, 266, 57/267, 270, 273, 274, 67

[56] References Cited

U.S. PATENT DOCUMENTS

| | | | |
|---|---|---|---|
| 4,515,328 | 5/1985 | Payne, Jr. | 242/131 |
| 4,888,946 | 12/1989 | Marzioli | 57/267 |
| 5,127,788 | 7/1992 | Schulz | 414/331 |

FOREIGN PATENT DOCUMENTS

| | | |
|---|---|---|
| 0311069 | 9/1993 | European Pat. Off. . |
| 61-119730 | 6/1986 | Japan . |
| 61-174432 | 8/1986 | Japan . |
| 61-197376 | 9/1986 | Japan . |
| 62-104934 | 5/1987 | Japan . |
| 63-6122 | 1/1988 | Japan . |
| 63-29016 | 6/1988 | Japan . |
| 63-61418 | 11/1988 | Japan . |
| 2127368 | 5/1990 | Japan . |
| 64-1827 | 2/1994 | Japan . |

*Primary Examiner*—Daniel P. Stodola
*Assistant Examiner*—Tina R. Taylor
*Attorney, Agent, or Firm*—Brooks Haidt Haffner & Delahunty

[57] ABSTRACT

A bobbin transporting system are overhead transporting rail for the flyer frames and an overhead transporting rail for spinning machines are disposed independent of each other. The bobbin transporting carrier running on the transporting rail for the flyer frames suspends the bobbin hangers at a pitch equal to that of bobbin wheels of the flyer frame arrayed in one of two rows in which the bobbin wheels are disposed in a zigzag pattern. The bobbin transporting carrier running on the transporting rail for the spinning frames suspends bobbin hangers at a pitch equal to that of reserve roving bobbins disposed at both sides of a spinning machine. A bobbin exchanging apparatus is disposed at a location where both the transporting rails extend in parallel and close to each other. In the bobbin exchanging apparatus, bobbins suspended at different pitches from the respective bobbin transporting carriers travelling on the transporting rails in opposite directions, respectively, are exchanged.

16 Claims, 16 Drawing Sheets

BOBBIN TRANSPORTING SYSTEM FOR ROVING AND SPINNING MACHINES WITH APPARATUS TO EXCHANGE BOBBINS OF DIFFERING PITCHES

BACKGROUND OF THE INVENTION

1. Field of the Invention

The present invention relates to a bobbin transporting system for transferring bobbins between a flyer frame section and a spinning machine section for feeding full roving bobbins produced in the flyer frame section in a spinning mill to the spinning machine section while the empty bobbins having the rovings spent in the spinning machine section are transported back to the flyer frame section.

2. Description of Related Art

In a spinning mill, it is required to transport full roving bobbins manufactured by flyer frames for supplying them to the spinning machines while transporting back to the flyer frames the empty roving bobbins whose rovings have been spent in the spinning machines. Such transportation of bobbins are carried out by using bobbin transporting carriers which are adapted to run on overhead transporting rails installed between the flyer frame section and the spinning machine section (refer to Japanese Unexamined Patent Application Publications Nos. 104934/1987 (JP-A-62-104934) and 89333/1986 (JP-A-61-89333) and others).

In the spinning machine and the flyer frame, bobbin pitch (i.e., distance between the bobbins) as well as disposition thereof are so determined that the space for accommodating the bobbins can be decreased to a possible minimum in an attempt for downsizing these machines. In general, in the flyer frame, the bobbin wheel pattern is so set that the bobbins are disposed zigzag in two rows. On the other hand, in the spinning machine, two bobbin transporting carriers each suspending roving bobbins reserved for exchanging with the roving bobbins approaching the empty state are disposed at left and right sides, respectively, of the spinning machine. Thus, the pitch and disposition of the bobbin hangers suspended on the bobbin transporting carrier at a pitch corresponding to that of the reserve roving bobbins differ from those of the bobbin wheels disposed on the flyer frame. Under the circumstances, there arises necessity of changing the pitch of the bobbins in the course of process for exchanging the full bobbins on the bobbin wheels as manufactured by the flyer frame with the empty bobbins mounted on the bobbin transporting carrier fed back to the flyer frame.

By way of example, there is disclosed in Japanese Unexamined Patent Application Publication No. 197376/1986 (JP-A-61-197376) a bobbin transporting carrier of such a structure in which a plurality of supporting members interconnected pivotally by links are disposed in a zigzag fashion on the side of the flyer frame so that the bobbin hangers suspended on the supporting members, respectively, can be rearrayed to a zigzag pattern in two rows. With the structure of this known bobbin transporting carrier, the empty bobbins recovered from the spinning machine where the empty bobbins are disposed in a single row at a pitch specific to the spinning machine are rearrayed zigzag in two rows so as to conform with the disposition of the bobbin wheels on the flyer frame. Thus, the cop changing operation for exchanging the full bobbins with the empty bobbins can be simplified, which in turn means that the cop changer can be implemented in an inexpensive simple structure.

Further, in Japanese Unexamined Patent Application Publication No. 174432/1986 (JP-A-61-174432), there is disclosed a cop changer which can exchange the full bobbins manufactured by the flyer frame and disposed zigzag in two rows with the empty bobbins suspended above the flyer frame in one row on a bobbin transporting carrier by a predetermined number at one time by using a corresponding number of forks while running the cop changer intermittently at the front side of the flyer frame. This cop changer is equipped with two types of forks which are vertically movable for transferring the full bobbins and the empty bobbins, respectively, wherein the forks are disposed in a zigzag array corresponding to that of the bobbin wheels of the flyer frame at the lowered position, while in the lifted position corresponding to that of the bobbin transporting carrier, the forks are disposed in one row which corresponds to the row of the bobbin hangers. By actuating concurrently the two sets of plural forks, the full bobbins disposed zigzag in two rows can be exchanged with the empty bobbins arrayed in One row.

Furthermore, in Japanese Unexamined Patent Application Publication No. 6122/1988 (JP-A-63-6122), there is disclosed an apparatus in which full bobbins manufactured by the flyer frame are concurrently doffed onto a belt conveyor disposed along the flyer frame in the longitudinal direction thereof, wherein the full bobbins transported by the belt conveyors are mounted onto the bobbin hangers of the bobbin transporting carrier two by two at an end side of the flyer frame.

As an apparatus for moving the bobbin transporting carrier, there is known a feeding apparatus including a pair of rotatable members which can be rotated in the state gripping a supporting member mounted on the bobbin transporting carrier so that the rotating force of the rotatable members can be transmitted to the supporting member in the direction tangential thereto (refer to Japanese Unexamined Patent Application Publication No. 67368/1985 (JP-A-60-67368). This feeding apparatus has a simple structure and can be installed on the transporting rail at an interval shorter than the overall length of the bobbin transporting carrier.

However, in the case of the bobbin transporting carrier of the structure disclosed in the Japanese Unexamined Patent Application Publication No. 197376/1986, the rotatable members are incapable of gripping the supporting members in a section where the supporting members are disposed in a zigzag fashion. Further, in the bobbin transporting carrier under consideration, it is required to provide a large number of travelling or running rollers for supporting the supporting members disposed zigzag. Consequently, large number of rollers and bearings have to be installed. Since a plurality of (usually four) bobbin transporting carriers are allocated to one spinning machine, use of a large number of rollers and bearings makes the structure of the bobbin transporting carrier much complicated with the cost involved in the installation being significantly increased.

On the other hand, in the case of the cop changer disclosed in Japanese Unexamined Patent Application Publication No. 174432/1986, there is required in addition to the fork lift mechanism an inter-fork distance changing apparatus which is constituted by a plurality of grooved rotatable cams mounted on a spline shaft and a corresponding number of cam followers guided by guide grooves formed in the cams in order to change the distance between the forks so as to conform with the pitch of the bobbins. Thus, the structure of the cop changer becomes necessarily much complicated. Besides, a large number of parts required for implementing the cop changer involves increasing of cost for the installation. Additionally, because of the complicated structure, faults tend to take place very frequently, being accompanied with frequent failure in the doffing operation.

Further, in the apparatus disclosed in Japanese Unexamined Patent Application Publication No. 6122/1988, the bobbin exchanging apparatus for effecting the bobbin exchange at a machine end has to be provided for each of the flyer frames together with the transporting apparatus such as the belt conveyor. Furthermore, during the transportation of the doffed full bobbins, the empty bobbins and the full bobbins provide obstacle to the work for correcting erroneous winding of the roving which is automatically taken up upon restarting of the flyer frame or the work for binding together the broken rovings, making it impossible to perform these works.

Moreover, in the bobbin transporting systems known heretofore, the bobbin transporting carriers are used in common by the flyer frames and the spinning machines and a large number of bobbin transporting carriers are caused to travel on and along the transporting rails installed between the flyer frames and the spinning machines, incurring frequently traffic congestion. Thus, lots of time is required for the traffic control. Besides, the bobbin transporting carriers are often forced to await the bobbin exchange in the standby state for an extended period. Accordingly, the number of the bobbin hangers for the bobbin transporting carrier has to be so selected that the bobbin transporting carrier can be used in common by the flyer frame and the spinning machine, which makes it impossible to realize such bobbin transporting system in which the flyer frames and the spinning machines having different number of bobbins may coexist.

SUMMARY OF THE INVENTION

In the light of the state of the art described above, it is an object of the present invention to provide a bobbin transporting system for flyer frames and spinning machines, which system is capable of overcoming or mitigating various limitations ascribable to difference in pitch between the full roving bobbins manufactured by the flyer frame and the reserve bobbins disposed on the spinning machines, by allowing the bobbin transporting carriers suspending the bobbin hangers at different pitches to travel independent of each other in a flyer frame section and a spinning machine section, respectively.

In view of the above and other objects which will become apparent as the description proceeds, there is provided according to an aspect of the present invention a bobbin transporting system which includes first transporting rails along which first bobbin transporting carriers are movable within an array or row of flyer frames, second transporting rails along which second bobbin transporting carriers are movable within an array or row of spinning machines, wherein the first and second transporting rails are provided independent of each other, and bobbin exchanging apparatuses installed at locations where the first and second transporting rails extend close to each other and capable of exchanging the bobbins suspended at different pitches on the first and second bobbin transporting carriers, respectively.

With the arrangement of the bobbin transporting carrier described above, the bobbin transporting carriers travel independently on and along respective transporting rails installed independent of each other, wherein the bobbins suspended at different pitches on the individual bobbin transporting carriers are mutually exchanged by the bobbin exchanging apparatus, whereby the full bobbins manufactured by the flyer frame are transported to the spinning machines while the empty bobbins whose rovings have been spent in the spinning machines are transferred back to the flyer frames.

By operating the bobbin transporting carriers which differ in respect to the pitch at which the bobbin hangers or bobbins are suspended and which travel independent of each other in the flyer frame section and the spinning machine section, respectively, the various limitations ascribable to difference in the pitch between the full bobbins manufactured by the flyer frames and the reserve roving bobbins used in the spinning machines can successfully be overcome.

The transporting rail provided in association with the flyer frame array should preferably be constituted by rail sections which are so interconnected that the bobbin transporting carriers can move around all the flyer frames constituting the flyer frame array. By virtue of this arrangement, the bobbin exchanging apparatus disposed at a location at which the transporting rail for the flyer frames and the transporting rail for the spinning machines extend close to each other is sequentially fed with the bobbin transporting carriers each suspending the full bobbins manufactured by the flyer frame, wherein the full bobbins as transported are exchanged with the empty bobbins sent back from the spinning machines, being suspended on the bobbin transporting carriers provided for the spinning machines, by the bobbin exchanging apparatus which is common to a predetermined number of the flyer frames. Thus, the number of the bobbin exchanging apparatuses to be installed can be decreased to a possible minimum, because each of the bobbin exchanging apparatuses can be used in common for a plurality of flyer frames.

The transporting rails provided in association with the flyer frame array should preferably be installed independently for a plurality of flyer frame groups, respectively, and the bobbin exchanging apparatus should preferably be provided separately for each of the flyer frame groups at locations where the transporting rails provided for the flyer frame groups, respectively, extend close to the transporting rail of the spinning machine array. In the bobbin transporting system of the arrangement described above, the full bobbins suspended on the bobbin transporting carriers allocated to each of the transporting rails are recovered by the bobbin exchanging apparatus provided for each of the flyer frame groups to be exchanged with the empty bobbins. In other words, the bobbin exchange is performed for each group of the flyer frames. In this conjunction, it will readily be appreciated that when the types or sorts of the roving bobbins differ from one to another group of the flyer frames, the bobbin exchange is performed for each type of the roving bobbins. Thus, the rove bobbins of different types or grades are prevented from being mixed.

In a preferred mode for carrying out the invention, at least one of the transporting rail for the flyer frame array and the transporting rail for the spinning machine array should include a path forming a closed loop which extends through the bobbin exchanging apparatus. With the above arrangement of the bobbin transporting system, the bobbin transporting carriers suspending the full bobbins thereon after passing through the bobbin exchanging apparatus can travel straightforwardly to the spinning machine array by way of the closed loop path without need for the bobbin transporting carrier once passed through the bobbin exchanging apparatus to be fed back. Thus, the succeeding bobbin transporting carriers can be fed into the bobbin exchanging apparatus without interruption.

In another preferred mode for carrying out the invention, a feeding apparatus for imparting thrusts to the bobbin transporting carriers may be installed in association with each of the transporting rails at an interval which is shorter than the overall length of the bobbin transporting carrier. By virtue of this arrangement, the bobbin transporting carriers can run on and along the transporting rail solely and independently under the thrusts or driving forces applied from a plurality of feeding apparatuses in a relaying fashion. Thus, when compared with the system in which the bobbin transporting carriers are pulled by a traction machine, the rail space required for changing the travelling direction of the bobbin transporting carrier fed from an end of the machine frame can be spared, whereby the transporting rail can be shortened, to another advantage.

The transporting rail provided for the flyer frame array should preferably be branched into two branched rails in correspondence to the number of bobbin wheel rows at the places where doffing operation is performed, and two bobbin transporting carriers should preferably be disposed on the branched rails such that bobbin hangers thereof can be disposed zigzag in two rows in correspondence to a pattern in which the bobbin wheels are disposed. Owing to this arrangement, doffing operation of the cop changer can be simplified, which in turn means that the cop changer can be implemented in a simple structure, to another advantage.

In still another preferred mode for carrying out the invention, the bobbin exchanging apparatus may be comprised of a transfer drive means which includes a plurality of retaining means which can be fit to the bobbins and which are movable between a withdrawing position located immediately beneath a position where the bobbins are to be removed and a fitting position located immediately above a transfer destination position at which there are disposed empty bobbin hangers of a counterpart bobbin transporting carrier from which the bobbins have been withdrawn during traveling of the bobbin transporting carriers inclusive of the counterpart bobbin transporting carrier in respective directions by a pitch equivalent to the number of bobbins to be exchanged so that the succeeding bobbins to be exchanged are positioned just above the withdrawing position, wherein the retaining means corresponding to both bobbins to be exchanged are moved on respective paths interconnecting the withdrawing position and the fitting position, and a lift means for executing a stroke for lifting and lowering the retaining means at the withdrawing position and the fitting position, respectively, between a lifted position at which the bobbins to be exchanged can be fit to and withdrawn from the bobbin hangers and a lowered position at which a top of the bobbin fit to the retaining means is displaced downwards away from the bobbin hanger and at which the retaining means is incapable of engaging the bobbin suspended from the bobbin transporting carrier.

With the arrangement of the bobbin transporting system described above, the bobbin transporting carriers entering the bobbin exchanging apparatus in the directions opposite to each other are stopped, being positioned such that the bobbins to be exchanged which are located at the leading sides of the bobbin transporting carriers, respectively, are disposed immediately above the respective removal or withdrawing positions. Consequently, the leading bobbins of both the bobbin transporting carriers are disposed just above the respective retaining means disposed at the withdrawing or removal positions. Subsequently, the lift drive means is actuated to lift the respective retaining means once, whereby the bobbins to be exchanged are fit on the retaining means and withdrawn or removed. Subsequently, the transfer drive means and the feeding apparatus are driven, whereby the to-be-exchanged bobbins of both the bobbin transporting carriers as fit on the respective retaining means are displaced to the fitting position from the withdrawing position, while the succeeding bobbins to be next exchanged are disposed immediately above the withdrawing or removal position because the respective bobbin transporting carriers are moved in the respective travelling directions each by a distance equal to a pitch corresponding to the number of bobbins to be exchanged simultaneously. In this manner, the to-be-exchanged bobbins fit on the respective retaining means are disposed at respective fitting positions, while the bobbins to be next exchanged are disposed at respective withdrawing positions, whereby the empty bobbin hangers of the counterpart bobbin transporting carrier from which the bobbins have been removed are disposed immediately above the respective fitting positions. Starting from this state, the lift drive means is actuated, whereby the respective retaining means are lifted and lowered once at the respective fitting positions. When the retaining means are lifted, the to-be-exchanged bobbins of both the bobbin transporting carriers are mounted on the empty bobbin hangers of the counterpart bobbin transporting carriers, respectively. Upon completion of the first bobbin exchange cycle, the operation cycle succeeding to the lifting/lowering operation of the retaining means at the withdrawing position is repeated similarly. In this manner, the bobbins are exchanged between the bobbin transporting carriers by a predetermined number every time the bobbin transporting carriers are moved intermittently in the opposite directions, respectively. Since the bobbin exchange operation described above can be realized by repeating only the transfer operation on the paths connecting the withdrawing position and the fitting position and the lifting/lowering operation at the withdrawing position and the fitting position, the bobbin exchanging apparatus can be implemented in a simplified structure.

In still another mode for carrying out the invention, it is preferred to dispose a residual roving eliminating means in a section of the transporting rail provided for the spinning machine array which extends from the individual spinning machines to the bobbin exchanging apparatus for eliminating residual rovings from the empty bobbins suspended on the bobbin transporting carrier travelling in that section. By virtue of this arrangement, the residual rovings of the empty bobbins are removed by the residual roving eliminating apparatus before being transported into the bobbin exchanging apparatus, whereby the empty bobbins free of the residual rovings can be transferred back to the bobbin transporting carrier for the flyer frames.

Furthermore, the transporting rail for the spinning machine array should preferably be branched into a plurality of branched transporting rails at a position preceding to a location where the bobbin transporting carrier is transported into the bobbin exchanging apparatus so that the plurality of branched transporting rails extending in parallel constitute a standby place for the bobbin transporting carriers. With this arrangement, the bobbin transporting carriers may temporarily be stored at the standby place on the branched rails, respectively, when a large number of bobbin transporting carriers are dispatched to the bobbin exchanging apparatus at one time, so that the bobbin transporting carriers can sequentially and smoothly be transferred to the bobbin exchanging apparatus.

Preferably, a section of the transporting rail provided for the spinning machine array onto which the bobbin transporting carriers are fed out from the bobbin exchanging apparatus should be branched into a plurality of branched rails extending in parallel so that the branched rails constitute a stock place for the bobbin transporting carriers. With this arrangement, the bobbin transporting carriers suspending the full bobbins after passing through the bobbin exchanging apparatus can once be stored in the stock place so that the bobbin transporting carrier can be dispatched speedily to the spinning machine which demands the supply of full roving bobbins.

In a yet further preferred mode for realizing the bobbin transporting system according the invention, the bobbins may be mounted in the suspended state on the bobbin hangers of the bobbin transporting carriers running on the transporting rails at a pitch which differs from one to another bobbin transporting carrier, wherein the full bobbins and the empty bobbins are exchanged by a predetermined number at one time by the bobbin exchanging apparatus upon every exchanging operation thereof while moving intermittently the bobbin transporting carriers oppositely in the respective travelling directions.

In the bobbin transporting system of the structure described above, the bobbins suspended on the bobbin hangers at different pitches on the bobbin transporting carriers running on different transporting rails can be exchanged by combining two simple operations, i.e., the lifting/lowering operation of the retaining means and the feeding operation mentioned hereinbefore. Thus, the apparatus employed to this end can be implemented in a simplified structure.

According to another aspect of the invention, there is provided a bobbin transporting system which includes an endless conveyor member spanned between a pair of pullies disposed with a distance therebetween which is greater than a distance between the withdrawing position and the fitting position, wherein at least three retaining means are provided on an outer peripheral surface of the endless conveyor member with equi-distance therebetween, which corresponds to the distance between the withdrawing position and the fitting position, and wherein the endless conveyor member is revolved by the transfer drive means in one direction in which the retaining means move from the withdrawing position toward the fitting position.

In the bobbin transporting system of the structure described above, the removal of the bobbin at the withdrawing position and the fitting of the bobbin at the fitting position can be carried out concurrently by lifting and lowering the retaining means only once. Besides, when the retaining means is moved from the withdrawing position to the fitting position, another retaining means for withdrawing the succeeding bobbin is disposed at the withdrawing position. Thus, the time required for executing one cycle of bobbin exchange can advantageously be shortened.

According to yet another aspect of the invention, the bobbin exchanging apparatus includes a number of the retaining means for exchanging the full bobbins suspended on the bobbin transporting carrier running on the transporting rail provided for the flyer frame array with the empty bobbins suspended on the bobbin transporting carrier running on the transporting rail provided for the spinning machine array, wherein paths along which the retaining means transferring the full bobbins are moved, respectively, are so established separately as to be inclined substantially uniformly relative to a center line extending orthogonally to the path along which the bobbin transporting carriers travel.

With the arrangement of the bobbin transporting system described above, large angles can be assured between the path for the bobbin transporting carrier and the paths for the retaining means transporting the full bobbins, respectively. Thus, the full bobbins to be exchanged can advantageously be transferred linearly without engaging other full bobbins suspended on the bobbin transporting carrier.

More specifically, the bobbin transporting system according the invention may include the bobbin exchanging apparatus, feeding means provided in association with the transporting rail for imparting thrusts to the bobbin transporting carriers travelling through the bobbin exchanging apparatus and a control means for controlling the feeding means, the transfer drive means and the lift driving means, wherein the control means is so arranged as to stop the feeding means when the bobbins suspended at a leading side of the bobbin transporting carrier transported into the bobbin exchanging apparatus under thrust exerted by the feeding means are positioned immediately above the respective withdrawing positions, actuate the lift drive means for lifting and lowering once the retaining means disposed at the withdrawing position, actuate the transfer drive means for moving the retaining means from the respective withdrawing positions to the respective fitting position when the retaining means is again disposed at the lowered position after the lifting operation, driving the feeding means to thereby move the bobbin transporting carriers so that the bobbins to be next exchanged are disposed immediately above the withdrawing position, and actuate the lift drive means for lifting and lowering once the retaining means when the retaining means are disposed at the fitting position and when the bobbins to be next exchanged are disposed at the withdrawing position, wherein the operation cycle succeeding to the actuation of the lift drive means in the state in which the retaining means are disposed at the withdrawing position is repeated.

In the bobbin transporting system of the structure described above, the bobbins suspended on the bobbin hangers at different pitches on the bobbin transporting carriers running on different transporting rails can be exchanged by combining two simple operations, that is, the lifting/lowering operation of the retaining means and the feeding operation mentioned hereinbefore. Thus, the apparatus employed to this end can be implemented in a simplified structure.

According to yet another aspect of the invention, the control means is so programmed as to control the transfer drive means and the lift drive means such that tops of the bobbins fit to the retaining means are positioned between the bobbin hangers and bottom ends of the bobbins suspended from the bobbin transporting carrier when the retaining means lifted and lowered at the withdrawing position and the fitting position is at the lowered position and that after the retaining means have been lifted and lowered once, the bobbins fit to the retaining means are prevented from engaging with the bobbins suspended from the bobbin transporting carrier.

Owing to the arrangement described above, the to-be-exchanged bobbin fit on the retaining means are retracted onto a linear path where the bobbin mentioned above is prevented from engaging the bobbin suspended from the bobbin transporting carrier when the bobbin transporting carrier travels after withdrawal of the bobbin. Thus, upon removing of the retracted bobbin, it is unnecessary to withdraw the bobbin to such extent that the top end thereof is positioned lower than the bottom end of the suspended bobbin. Accordingly, the retaining means lifting/lowering stroke can be shortened, whereby the bobbin exchange speed can be increased.

Finally, according to the invention, there is further provided a bobbin transporting system in which during a process for moving the retaining means from the withdrawing position to the fitting position for fitting the bobbins to be exchanged to the retaining means, the control means controls the transfer drive means and the feeding means such that the retaining means is moved at a high speed while the bobbin transporting carrier is moved at a low speed when the bobbins to be exchanged are to be withdrawn from the row of the suspended bobbins, whereas when the bobbins to be exchanged are to be placed in the row of the suspended row, the retaining means is moved at a low speed while the bobbin transporting carrier is moved at a high speed, to thereby allow operations of the transfer drive means and the feeding means to be started and stopped simultaneously.

In the bobbin transporting system described above, the linear movement of the retaining means from the withdrawing position to the fitting position and the travel of the bobbin transporting carrier can be started and stopped simultaneously through the speed control mentioned above, the time taken for the bobbin exchange can further be decreased. Further, the simultaneous start/stop control is also pleasing in appearance.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
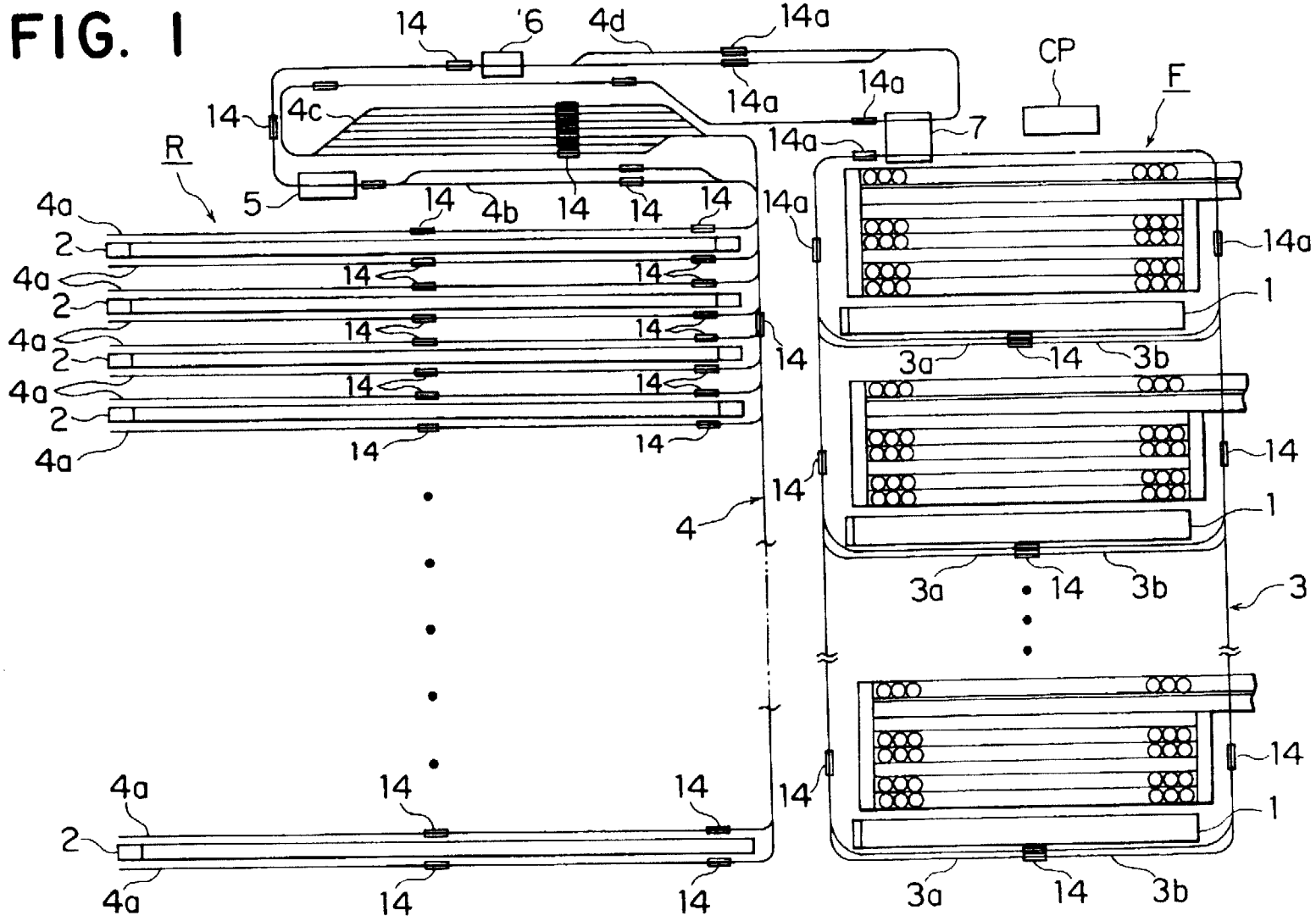
FIG. 1 is a top plan view showing a bobbin transporting system according to a first embodiment of the present invention.

Now, the present invention will be described in detail in conjunction with what is presently considered as preferred or typical embodiments thereof by reference to the drawings. In the following description, like reference characters designate like or corresponding parts throughout the several views.

Embodiment 1

A bobbin transporting system for roving and spinning machine arrays according to a first embodiment of the present invention will be described by reference to FIGS. 1 to 17.

As is shown in FIG. 1, a flyer frame array F including a plurality of flyer frames 1 arrayed in a row and a spinning machine array R including a plurality of spinning machines 2 arrayed rowwise (the number of which is greater than that of the flyer frames 1) are disposed adjacent to each other with a predetermined distance therebetween. A transporting rail 3 installed overhead at the side of the flyer frame array F extends in the form of a loop so as to encircle all of the flyer frames 1, wherein there are provided pairs of branched transporting rails 3*a* and 3*b* which are branched from the loop of the transporting rail 3 at positions corresponding to both ends of machine frames of the flyer frames 1, and extend at front sides (lower sides, as viewed in FIG. 1) of the individual flyer frames 1 overhead thereof, respectively, in the direction longitudinally of the machine frame.

On the other hand, a transporting rail 4 installed overhead at the side of the spinning machine array R is equipped with a pair of reserve transporting rails 4*a* which are branched from the transporting rail 4 at positions corresponding to the ends (rear ends) of the machine frames of the individual spinning machines 2, respectively, and extend at left and right sides (upper and lower sides, as viewed in FIG. 1) of the machine frames of the spinning machines 2, wherein transporting rail 4 extends orthogonally to the reserve transporting rails 4*a* along the periphery of the spinning machine array R and bends at a position adjacent to a top corner of the spinning machine array R to form a closed loop. Provided in this closed loop are three pool line sections (stock sections) 4*b*, 4*c* and 4*d* in each of which a plurality of branch lines extend in parallel with one another, wherein the pool line section 4*d* extends to the rear side of the flyer frame array F and bends so us to extend closely to the transporting rail 3 in parallel therewith. Disposed on the path forming the closed loop are an adhering roving scraper device (hereinafter referred to as the ARS device) 5 and a cutting device 6 for removing rovings adhering to empty bobbins EB transported from the spinning machine 2. Additionally, a bobbin exchanging apparatus 7 is installed at a position located close to the transporting rail 3 at the rear side of the flyer frame array F in such a disposition as to straddle across two transporting rails 3 and 4, as will be described later in detail. The ARS device 5 serves for removing the residual rovings from the empty bobbins EB while the cutter device 6 serves for the function for completely eliminating by cutting the residual rovings which can not be removed by the ARS device 5.

Figure 15:
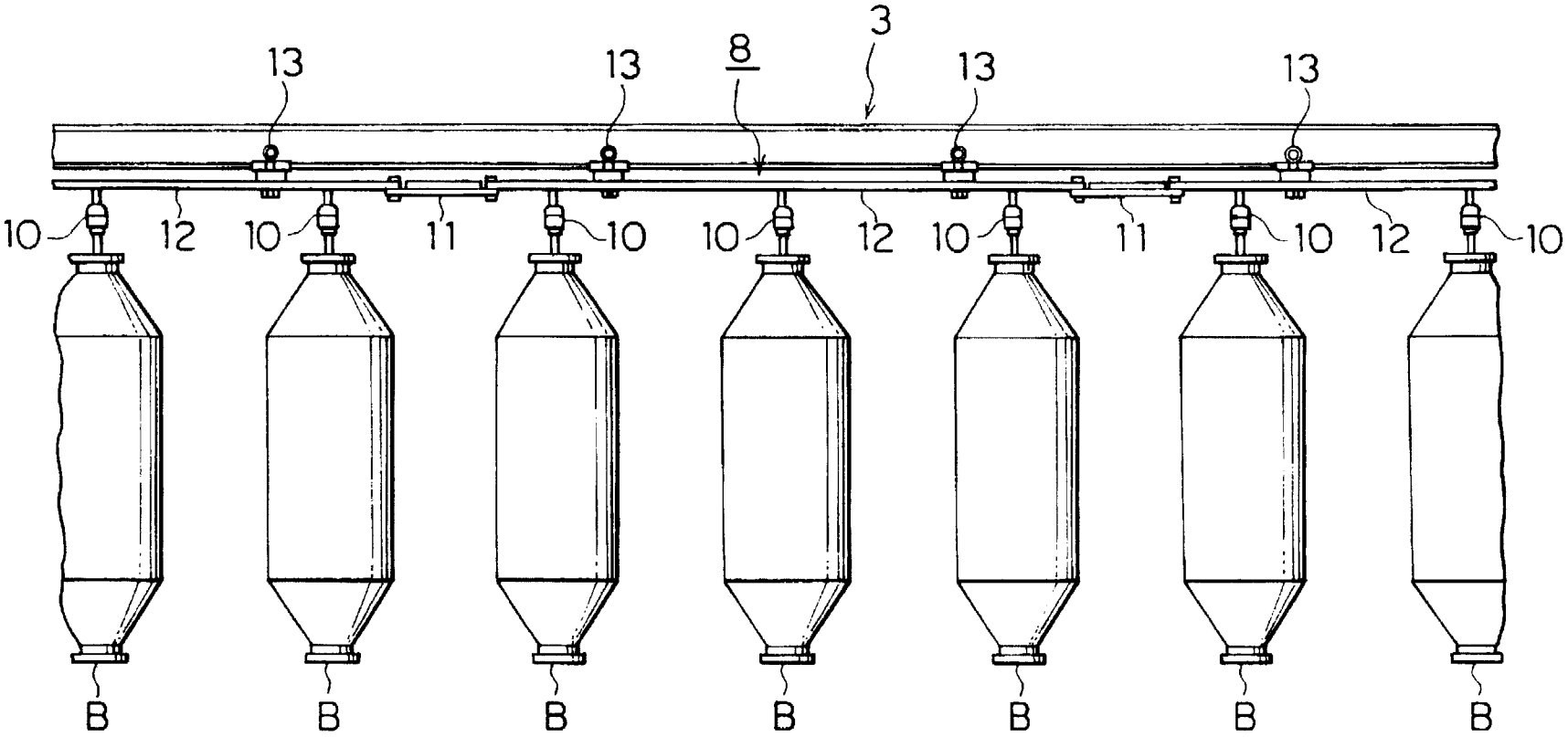
FIG. 15 is a side elevational view of a bobbin transporting carrier for a flyer frame array.

Provided in association with the transporting rail 3 are bobbin transporting carriers 8 each having an overall length substantially equal to the machine frame length of the flyer frame 1 and implemented in a structure shown in FIG. 15 so that the bobbin transporting carriers 8 can run on and along the transporting rail 3, wherein each of the flyer frames 1 is allocated with a pair of the bobbin transporting carriers 8 for receiving the service thereof. On the other hand, disposed in association with the transporting rail 4 are bobbin transporting carriers 9 each having an overall length approximately equal to a half of the machine frame length of the spinning machine 2 and having a structure shown in FIG. 16 so that the bobbin transporting carriers 9 can run along the transporting rail wherein each of the spinning machines 2 is allocated with four bobbin transporting carriers 9 and additionally several auxiliary bobbin transporting carriers.

Figure 16:
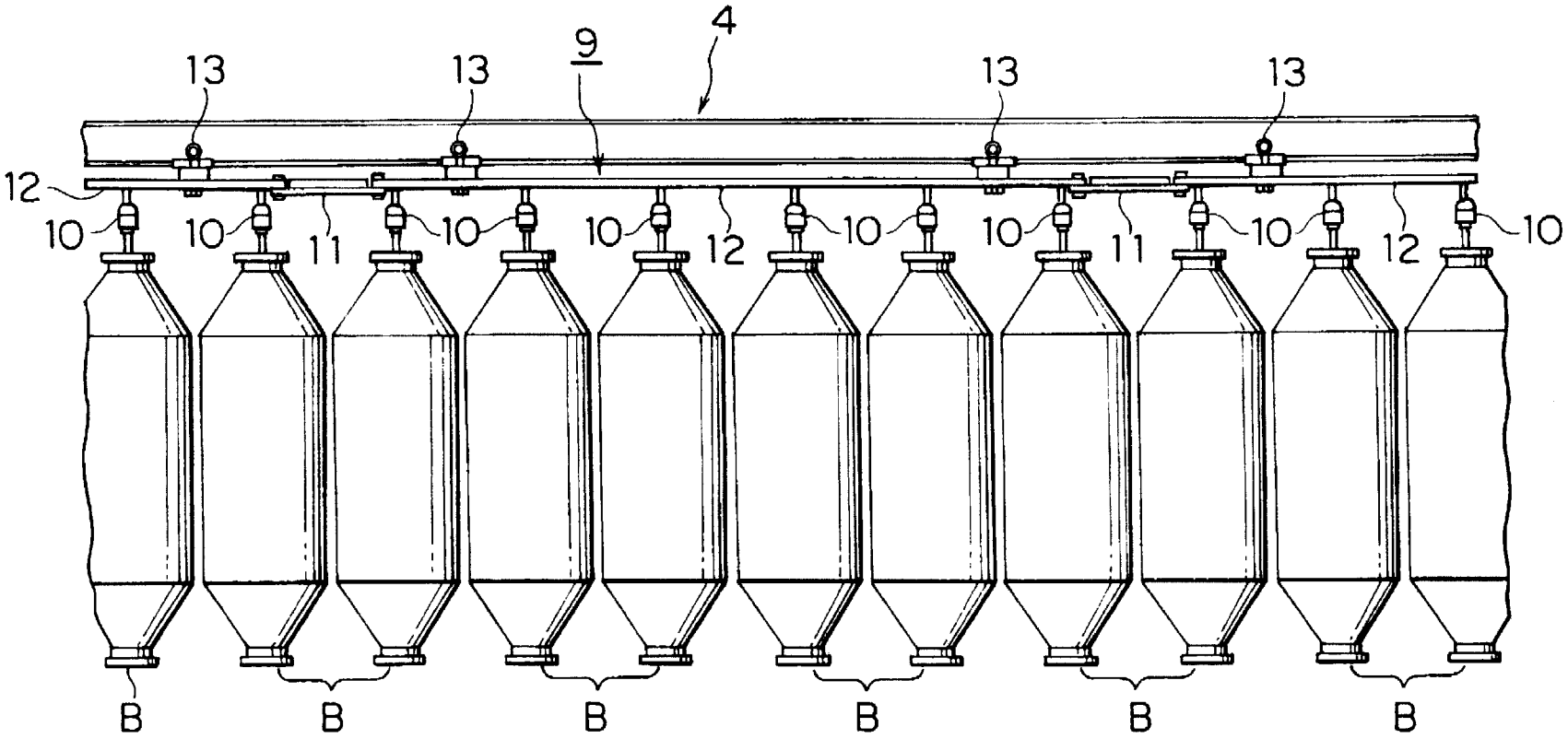
FIG. 16 is a side elevational view of the bobbin transporting carrier for a spinning machine array.
Figure 17A:
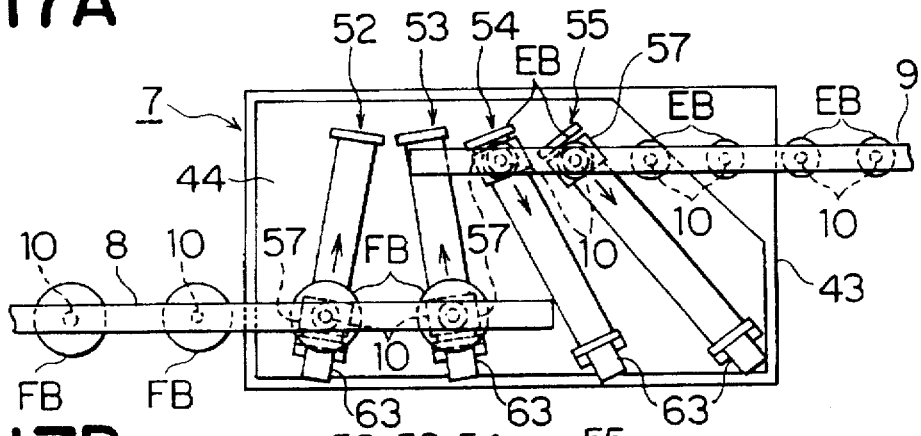
FIG. 17 is a diagram for illustrating a sequence of operations involved in a bobbin transferring process.
Figure 17B:
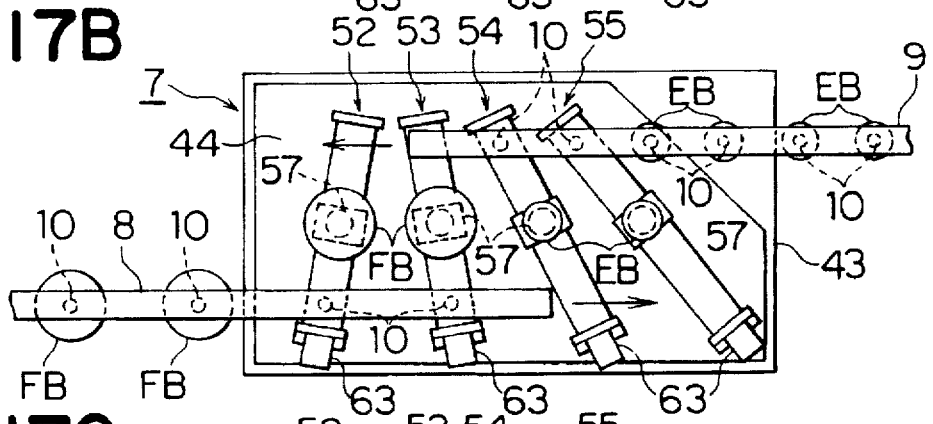
Figure 17C:
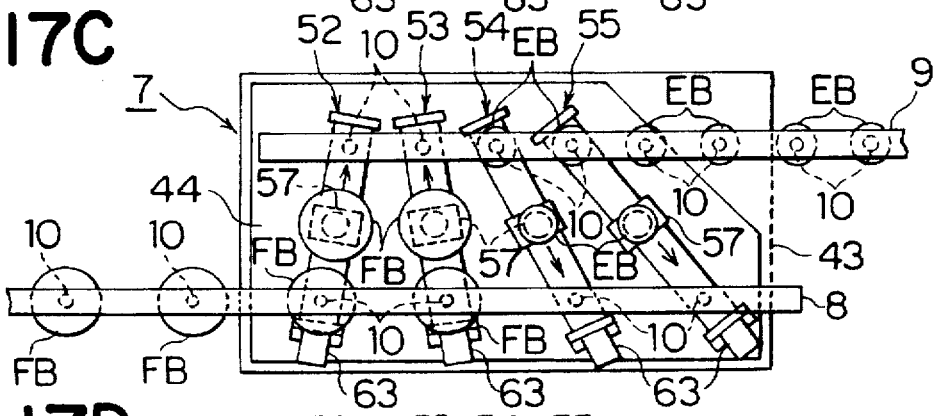
Figure 17D:
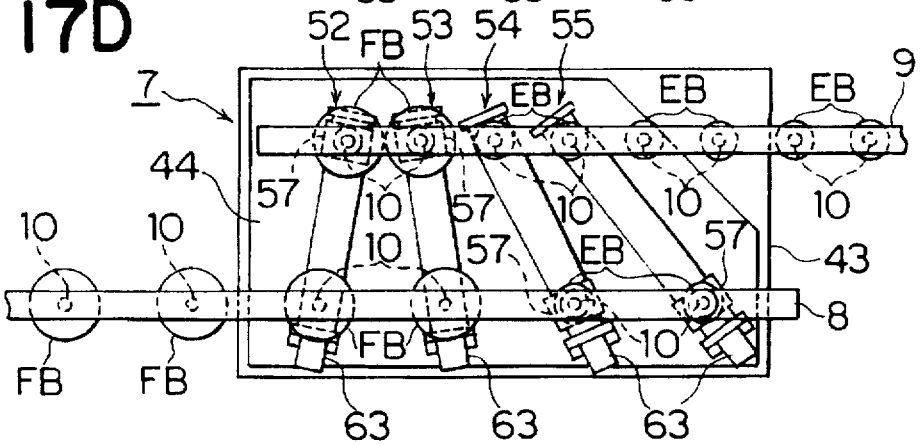

Now referring to FIGS. 15 and 16, each of the bobbin transporting carriers 8 and 9 includes a plurality of link member 12 which are pivotally interconnected by means of interconnecting members 11 so as to be pivotal in a horizontal plane (i.e., plane orthogonal to the plane of the drawing) and on which bobbin hangers 10 are suspended at a predetermined interval. The link members 12 are suspended on the respective transporting rail 3 or 4 via travelling rollers 13 so as to be movable on and along the transporting rail 3 or 4 in the state in which the bobbin hangers 10 are suspended on the link members 12. Each of the interconnecting members 11 is so formed as to project into a gap between the adjacent link members 12 in a same thickness as the width of the link member 12 (thickness of the link member 12 as viewed in the direction orthogonal to the plane of the drawing, to say in another way), while each of the bobbin transporting carriers 8 and 9 is so formed as to have a same width as that of the link member 12 over the whole length thereof inclusive of those portions corresponding to the interconnecting member 11.

As is shown in FIG. 15, the bobbin hangers 10 of the bobbin transporting carrier 8 are disposed with a distance therebetween which is equal to the pitch of one row of bobbin wheels which bobbin wheels are disposed in a zigzag fashion in two rows at the front and back, respectively, of the flyer frame 1. Further, the bobbin hangers 10 of the bobbin transporting carrier 8 are suspended at an interval approximately equal to the pitch of reserve roving bobbins suspended on a creel of the spinning machine 2. In other words, the pitch of the bobbin hangers 10 of the bobbin transporting carrier 8 is selected to be greater than that of the bobbin hangers 10 of the bobbin transporting rail 9, as can be seen in FIGS. 15 and 16.

The bobbin transporting carriers 8 and 9 can travel on and along the transporting rails 3 and 4 under a thrust or driving force supplied via the link members 12 from feeding apparatuses 14 and 14*a* disposed in pluralities on the transporting rails 3 and 4, respectively, when the carriers 8 and 9 are put into engagement with the feeding apparatuses. In this conjunction, it is to be mentioned that the feeding apparatuses 14 and 14*a* are disposed for the transporting rails 3 and 4 at a shorter interval than the overall length of the bobbin transporting carriers 8 and 9 running on the transporting rails 3 and 4, respectively. The feeding apparatus 14*a* is controlled by a control apparatus C described hereinafter for controlling the travel of the bobbin transporting carriers 8, 9 fed to the bobbin exchanging apparatus 7. Parenthetically, with regard to the structure, the feeding apparatus 14*a* is essentially identical with the feeding apparatus 14.

In the flyer frame array F, cop changers (not shown) disclosed in Japanese Unexamined Patent Application Publication No. 119730/1986 (JP-A-61-119730) are provided so as to be movable between the individual flyer frames 1. Each of the cop changers is adapted to run intermittently at the front of the flyer frame 1 whose operation is stopped upon formation of full bobbins to thereby allow a predetermined number of full bobbins disposed in two rows on the bobbin wheels to be simultaneously exchanged with a corresponding number of empty bobbins suspended on the bobbin transporting carrier 8 which is in the standby state on the branched transporting rails 3*a*, 3*b*. Of course, a simultaneous cop changer disclosed in Japanese Unexamined Patent Application Publication No. 41827/1994 (JP-A-6-41827) may be adopted for exchanging simultaneously all the empty bobbins with the full bobbins.

On the other hand, in the spinning machine array R, a pair of roving bobbin exchanging apparatuses (not shown) disclosed in Japanese Unexamined Patent Application Publication No. 127368/1990 (JP-A-2-127368) are disposed movably from one to another spinning machine 2. The roving bobbin exchanging apparatus is so arranged that when the roving bobbins suspended on the creel come closer to the empty state, the roving bobbin exchanging apparatuses run intermittently at left and right sides of the machine frame of the relevant spinning machine 2 to thereby exchange a predetermined number of the empty bobbins coming closer to the empty state simultaneously with a corresponding number of the full roving bobbins suspended on the bobbin transporting carrier 9 waiting for the bobbin exchange on the reserve transporting rail 4*a*.

A pair of bobbin transporting carriers 8 on which the full bobbins FB are suspended through doffing operation as performed by the cop changer are adapted to run from the branched transporting rails 3*a*, 3*b* onto the transporting rail 3 by way of the bobbin exchanging apparatus 7 in the clockwise direction as viewed in FIG. 1.

On the other hand, four bobbin transporting carriers 9 now suspending the empty bobbins EB after the bobbin exchanging operation performed by the roving bobbin exchanging apparatus run from the reserve transporting rail 4*a* onto the transporting rail 4 upwardly, as viewed in FIG. 1, to travel along the loop path located adjacent to the spinning machine array R in the clockwise direction. After removal of the residual rovings through cooperation of the ARS device 5 and the cutter device 6, the empty bobbins EB are transported into the bobbin exchanging apparatus 7.

The bobbin transporting carrier 8 is capable of transporting sixty bobbins B simultaneously, while the bobbin transporting carrier 9 has a capability of transporting one hundred and twenty bobbins B at one time. In the bobbin exchanging apparatus 7, the bobbin transporting carriers 8 and 9 move intermittently in the opposite directions, respectively, to thereby allow the full bobbins FB transported by the bobbin transporting carrier 8 to be exchanged with the empty bobbins EB transported by the bobbin transporting carrier 9 on a two-by-two basis.

After passage through the bobbin exchanging apparatus 7, the bobbin transporting carrier 8 having the empty bobbins EB suspended thereon travels around along the transporting rail 3. Upon arrival at the starting position located above the associated flyer frame 1, the bobbin transporting carrier 8 is again set to the standby state on the branched transporting rails 3*a*, 3*b*. On the other hand, the bobbin transporting carrier 9 loaded with the full bobbins FB at the bobbin exchanging apparatus 7 is temporarily set to the standby state in the pool line section 4*c*, as occasion requires, and travels to the spinning machine 2 demanding the supply of reserve full bobbins FB to assume a standby state at a predetermined position on the reserve transporting rail 4a.

Next, the bobbin transporting carriers 8 and 9 and the feeding apparatus 14 will be described in detail.

Figure 10:
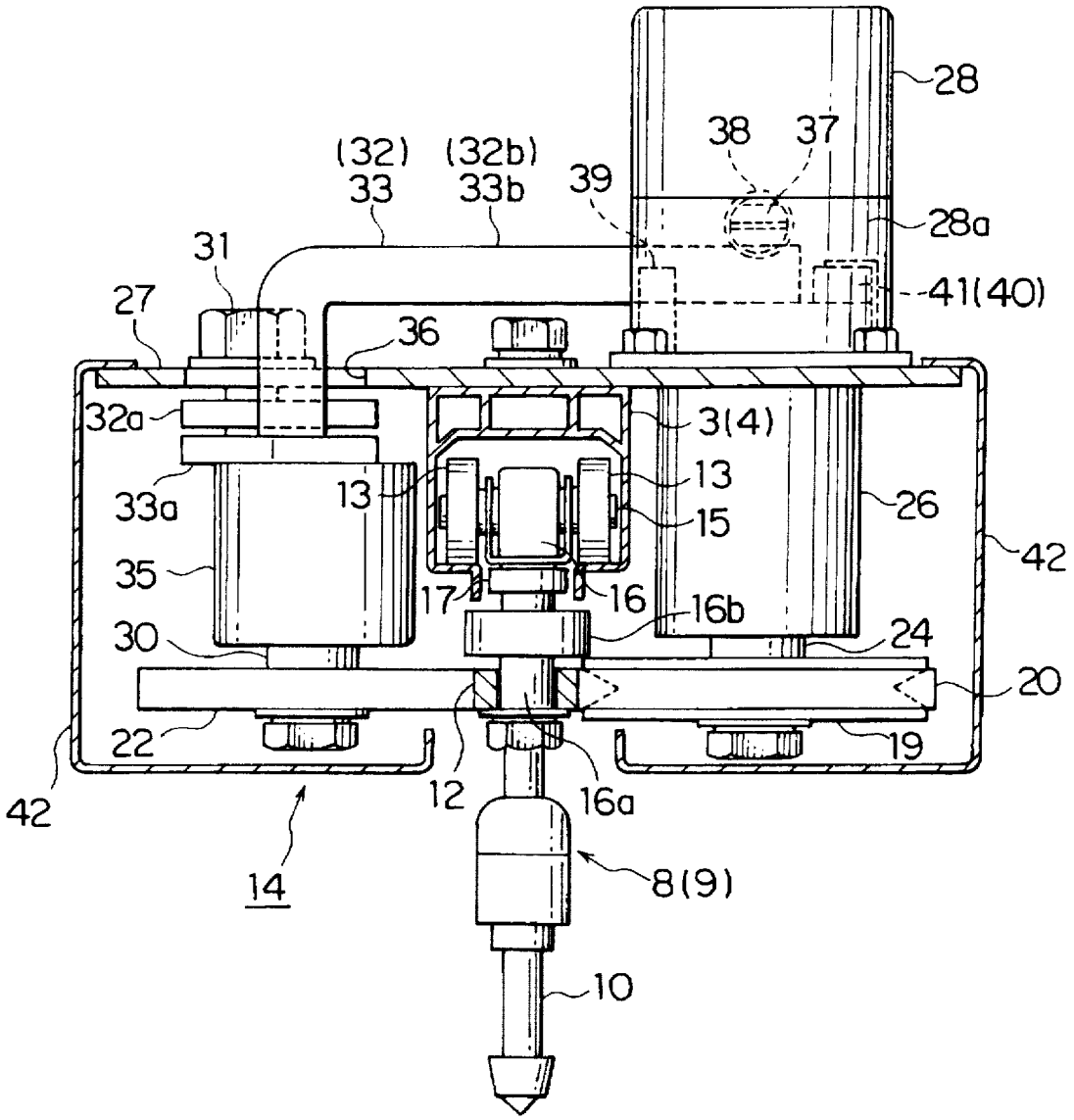
FIG. 10 is a front sectional view showing a bobbin transporting carrier and a feeding apparatus.

As shown in FIG. 10, each of the transporting rails 3 and 4 is formed as to have generally an inverted U-like cross-section opening downwardly. A pair of travelling rollers 13 provided at left and right sides, respectively, of the transporting rail 3, 4, as viewed in the direction widthwise thereof, are adapted to roll on and along horizontal surfaces of protrusions formed stepwise at the bottom of the transporting rail 3, 4 and extending inwardly thereof. A supporting member 16 which depends from a supporting shaft 15 for the travelling rollers 13 includes a supporting rod 16a extending downwardly, wherein bottom portions of the supporting rod 16a extend through the link member 12 at both end portions thereof so that the link member 12 is rotatable about the supporting rod 16a. In this state, the link member 12 is fixedly clamped and supported in the suspended state.

Disposed in the opening of the transporting rail 3, 4 in association with the supporting member 16 a pair of guide rollers 17 at front and rear sides, respectively, of the supporting member 16, wherein the guide rollers 17 bear against the inner wall surfaces of the transporting rail 3, 4 so that the steering angle of the travelling roller 13 can be changed along the route or path defined by the transporting rail 3, 4. Further, the supporting rod 16a is formed with a regulating portion 16b projecting horizontally which is adapted to bear against a lower edge portion of the transporting rail 3, 4 to thereby suppress irregular movement of the bobbin transporting carrier 8, 9 in the vertical direction.

As is shown in FIGS. 10 to 14, the feeding apparatus 14 is comprised of a belt 20 having a V-like cross-section and spanned across a pair of pulleys 18 and 19 and a pair of rollers 21 and 22 disposed in opposition to the other periphery of the belt 20 with a path for the link member 12 of the bobbin transporting carrier 9, 8 extending between the rollers 21 and 22 and to the outer periphery of the belt 20.

Rotatable shafts 23 and 24 for supporting the pulleys 18 and 19 are rotatably journaled by bearings 25 and 26, respectively. Installed on the top surface of a supporting plate 27 (not shown in FIG. 14) which supports the transporting rail 3, 4 is an electric motor (geared motor) 28 equipped with a gear box 28a shown in FIGS. 10 to 14 at a position corresponding to the bearing 26. The electric motor 28 is constituted by a reversible motor whose driving shaft (not shown) is operatively connected to the rotatable shaft 24 by way of a gear train accommodated within the gear box 28 *a*. The bearings 25 and 26 are fixedly mounted on the supporting plate 27. At this juncture, it is to be noted that the position of the bearing 25 can be changed for adjusting the tension applied to the belt 20.

On the other hand, rotatable shafts 29 and 30 for supporting the rollers 21 and 22, respectively, are rotatably journaled by means of bearings 34 and 35, respectively, which are fixedly secured to bottom surfaces of supporting portions 32a and 33a of two arm levers 32 and 33 at one ends thereof, respectively. The arm levers 32 and 33 in turn are mounted on the supporting shaft 31 rotatably relative to the supporting plate 27.

The arm levers 32 and 33 have arms 32b and 33b, respectively which extend through a pair of through-holes 36 from the supporting portions 32a and 33a upwardly beyond the supporting plate 27 and disposed in the state extending to the rear side (right side as viewed in FIG. 10) orthogonally to the longitudinal axes of the supporting portions 32a and 33a, respectively, approximately at a right angle. Disposed between the arm levers 32 and 33 at rear ends of the arms 32b and 33b, respectively, is a spring 38 under tension by means of cylindrical retaining members formed at the rear end portions of the arms 32b and 33b on the top surfaces thereof, respectively. The arms 32b and 33b of the arm levers 32 and 33 are resiliently urged to be positioned closely to each other under the force of the spring 38, wherein rotations of the arm levers 32 and 33 in the direction in which the force of the spring 38 acts are limited by limiting or stopper pins 39, respectively, which project upwardly from the supporting plate 27. In the state where the arm levers bear against the stopper pins 39, the rollers 21 and 22 are held in the state in which they oppose to each other with a gap slightly smaller than the width of the link member 12 being formed relative to the belt 20.

Figure 11:
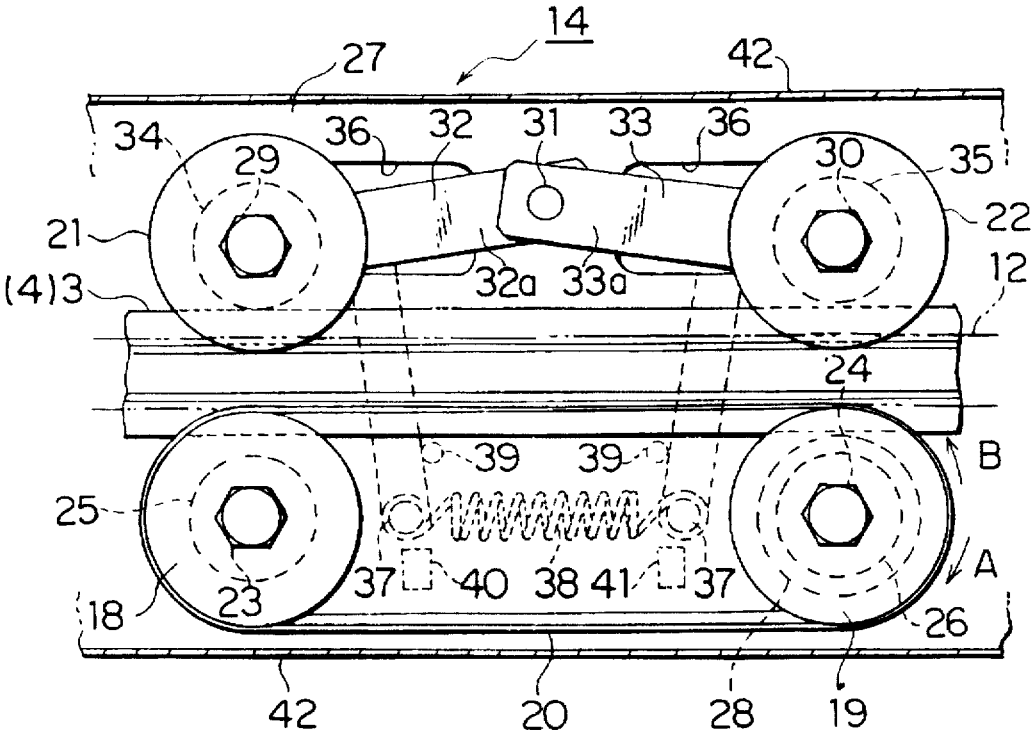
FIG. 11 is a bottom plan view of the feeding apparatus.
Figure 12:
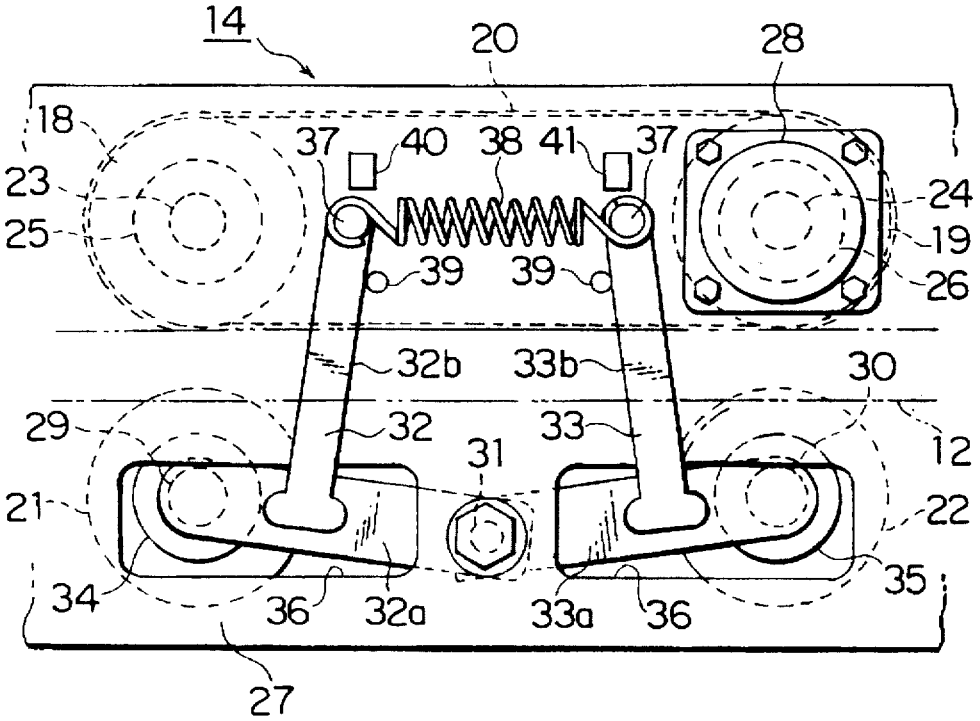
FIG. 12 is a top plan view of the same.

As shown in FIGS. 10 to 12, there are mounted on the supporting plate 27 a pair of proximity sensors 40 and 41 so as to be capable of detecting the rear end surfaces of the arms 32b and 33b, respectively. These proximity sensors 40 and 41 are turned off upon detection of the rear end surfaces of the arms 32b and 33b in the state where they bear against the stopper pins 39, as a result of which the link member 12 intrude into the gap defined between the roller 21, 22 and the belt 20 against the force exerted by the spring 38 to thereby move away the rollers 21 and 22 from each other. As a result of this, the arms 32b and 33b are caused to move away from the stopper pins 39, whereupon the proximity sensors 40 and 41 are turned on.

The electric motor 28 is adapted to be driven when at least one of the proximity sensors 40 and 41 is turned on. In that case, the direction of rotation of the electric motor 28 is determined by the sequence in which both the proximity sensors 40 and 41 are turned on. More specifically, when the proximity sensor 40 is closed or turned on in precedence, the electric motor 28 is driven in the forward direction to thereby rotate the pulley 19 in the direction indicated by an arrow A shown in FIG. 11, while when the proximity sensor or switch 41 is closed in precedence to the sensor 40, the electric motor 28 is caused to rotate in the reverse or backward direction, as a result of which the pulley 19 is rotated in the direction indicated by the arrow B. Incidentally, the portion of the feeding apparatus 14 disposed underneath the supporting plate 27 is covered by a cover member 42 which is secured to the supporting plate 27. Additionally, it is to be mentioned that in the feeding apparatus 14 disposed at a predetermined stop position of the bobbin transporting carrier 8, 9, operation of the associated electric motor 28 is stopped in response to a corresponding command issued from the control console CP shown in FIG. 1 regardless of the operation states of the proximity sensors 40 and 41.

Next, description will be made in detail of the bobbin exchanging apparatus 7.

Figure 2:
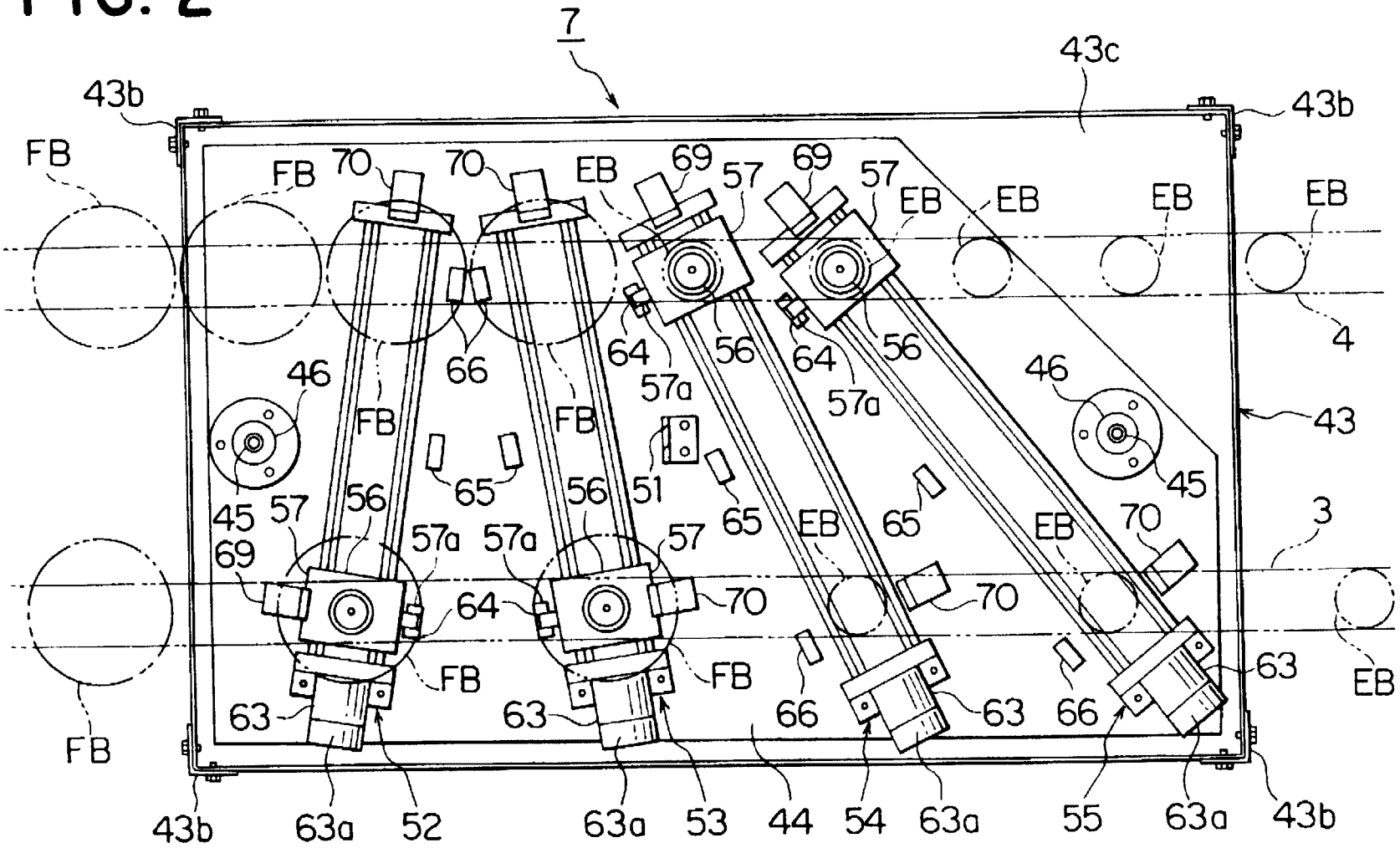
FIG. 2 is a top plan view showing a bobbin exchanging apparatus according to the first embodiment of the invention.
Figure 3:
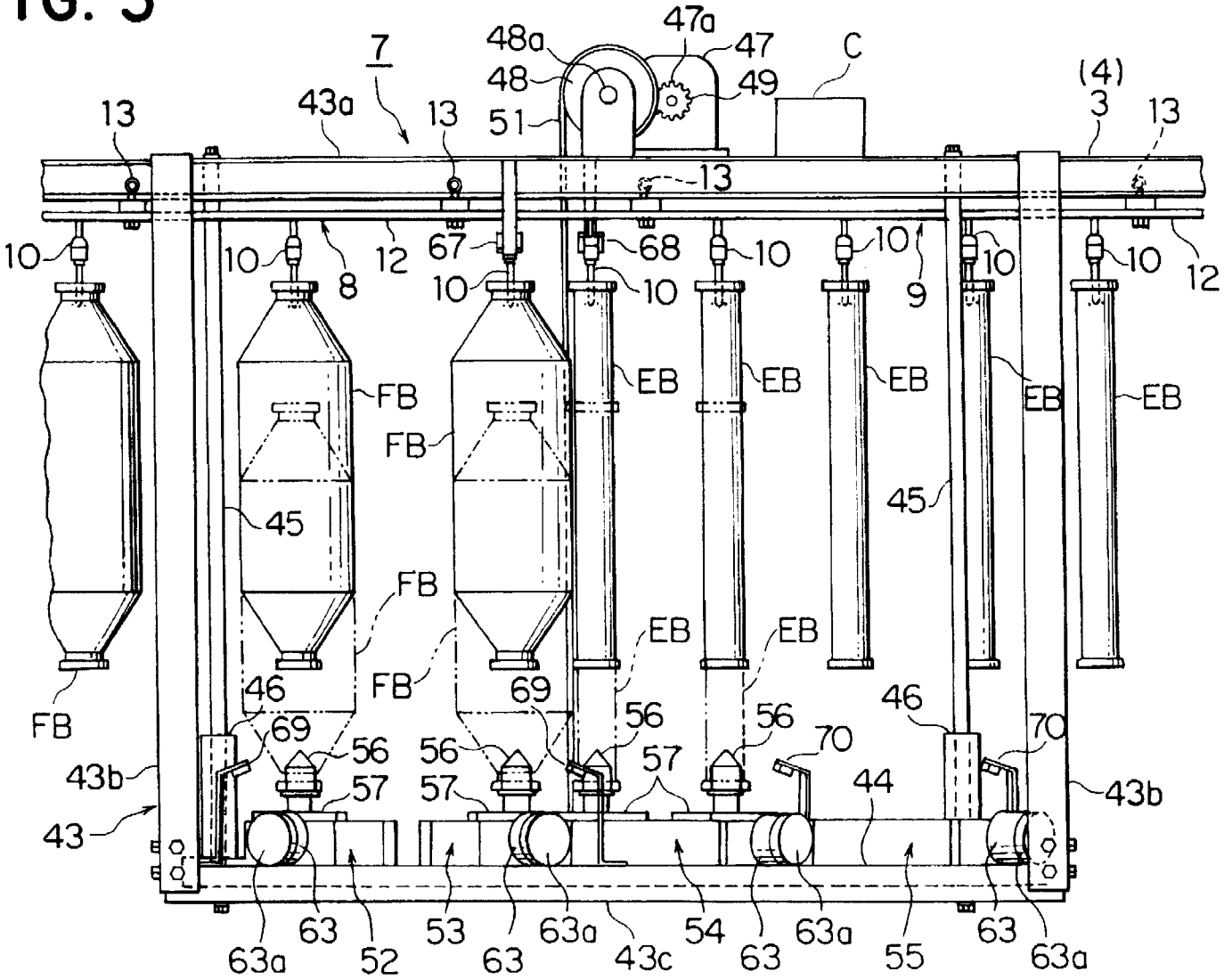
FIG. 3 is a partially broken side elevational view showing the bobbin exchanging apparatus in the state in which a table constituting the same is at a lowered position.
Figure 4:
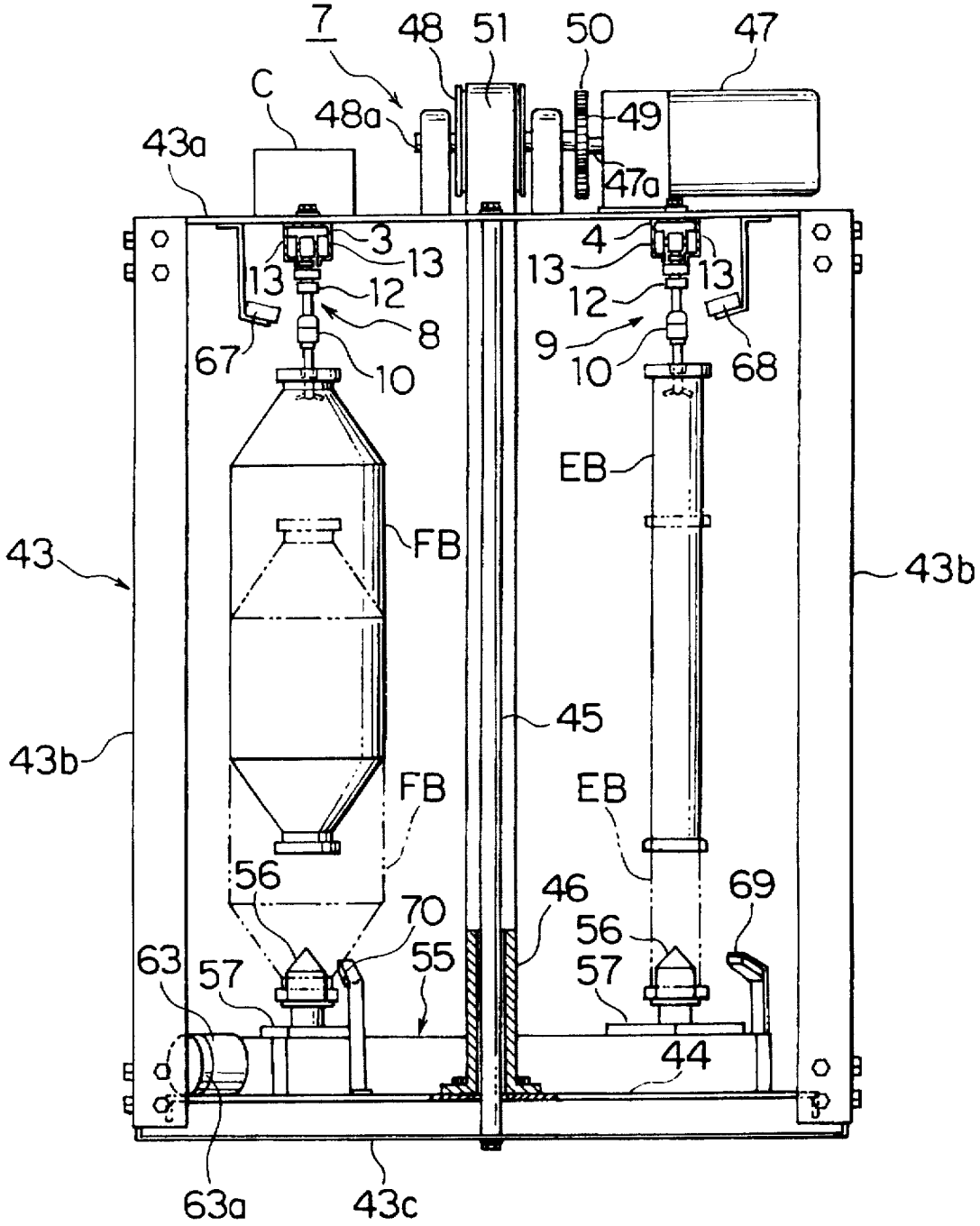
FIG. 4 is a partially broken front elevational view showing the bobbin exchanging apparatus in the state in which the table constituting the same is at the lowered position.

As is shown in FIGS. 2 and 4, the bobbin exchanging apparatus 7 is installed in a suspended state, straddling across the two transporting rails 3 and 4 which extend in parallel and in proximity to each other so that the bobbin transporting carriers 8 and 9 travel in opposite directions, respectively. The bobbin exchanging apparatus 7 includes a frame box 43 which is constituted by a supporting plate 43a disposed, as straddling across the transporting rails 3 and 4, four supporting members 43b extending downwardly from four corner portions of the supporting plate 43a and a bottom plate 43c supported by the supporting members 43b, wherein the frame box 43 is realized in the form of a box having four sides opened. The bobbin transporting carriers 8 and 9 can pass through the frame box 43 in the directions opposite to each other (i.e., one in the forward direction or to the left as viewed in FIGS. 2 and 3 while the other in the backward direction or to the right as viewed in the figures). More specifically, the full bobbins FB are carried into the bobbin exchanging apparatus 7 along the transporting rail 3 from the left side of FIG. 3, while the empty bobbins EB are transported into the bobbin exchanging apparatus 7 along the transporting rail 4 from the right side of FIG. 3.

As can be seen in FIGS. 2 to 4, a table 44 is so installed within the frame box 43 as to be movable in the vertical direction. In more concrete, there are disposed in the frame box 43 at the front and rear sides thereof a pair of guide rods 45 which extend vertically between the supporting plate 43*a* and the bottom plate 43*c* and fixedly secured thereto at top and bottom end, respectively, as is shown in FIGS. 2 to 4. On the other hand, guide sleeve members 46 are secured to the table 44 at the front and rear ends thereof, respectively, in such disposition that the guide members 45 are slideably inserted through the guide sleeve members 46, respectively. In this manner, the table 44 can be moved upwardly or downwardly, being guided by the guide rods 45 inserted through the guide sleeve members 46, respectively.

Installed on the frame box 43 at the top surface thereof are a lift motor 47 and a drum 48 in such disposition in which a gear 49 mounted on a drive shaft 47*a* of the lift motor 47 meshes with a gear 50 mounted on the rotatable shaft 48*a*. Wound around the drum 48 is a metal belt 51 which has a bottom end portion secured to the top surface of the table 44 at a center portion thereof. The lift motor 47 is constituted by a reversible electric motor, the operation of which is controlled by the control apparatus C installed on the supporting plate 43*a*. By driving the lift motor 47 in the forward or backward (reverse) direction, the drum 48 is rotated in the corresponding direction at a rotation speed which is determined by the a gear ratio of the gears 49 and 50, whereby the metal belt 51 is wound up or delivered to thereby allow the table 44 to move upwardly or downwardly between the lowered position shown in FIGS. 3 and 4 and a lifted position shown in FIGS. 5 and 6.

Again referring to FIGS. 2 to 4, there are disposed four slide base apparatuses 52, 53, 54 and 55 on the table 44, each including a base plate 57 which is mounted slideably in the longitudinal direction, wherein an upstanding peg 56 is secured to the base plate 57 for serving as a retaining means to be removably fit into a socket formed in the bobbin B.

As is shown in FIG. 2, in the slide base apparatuses 52 to 55, the pegs 56 are so positioned that when they are disposed just below the transporting rail 3, the space between the pegs 56 is equal to the bobbin hanger pitch of the bobbin transporting carrier 8, while when the pegs 56 are positioned underneath the transporting rail 4, the space between the pegs 56 is equal to the bobbin hanger pitch of the bobbin transporting carrier 9. At this juncture, it should be mentioned that the slide base apparatuses 52 and 53 are disposed symmetrically relative to a line orthogonal to the transporting rail 3, 4 in a horizontal plane, being inclined in the opposite directions, respectively, with a same angle of inclination relative-to the line mentioned above, while the slide base apparatuses 54 and 55 are disposed with an angle of inclination relative to the slide base apparatus 53 so that the conditions concerning the spaces between the pegs 56 as described above can be satisfied. Each of the base plates 57 of the slide base apparatuses 52 to 55 is adapted to move slideably by means of a so-called ball-screw mechanism.

Figure 7:
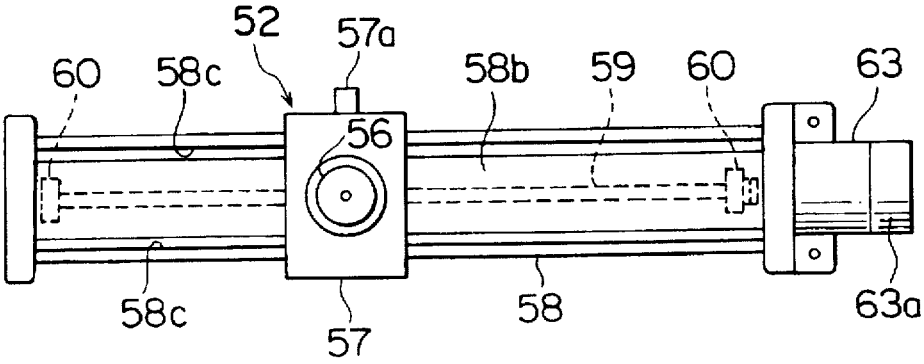
FIG. 7 is a top plan view of a slide base apparatus.
Figure 8:
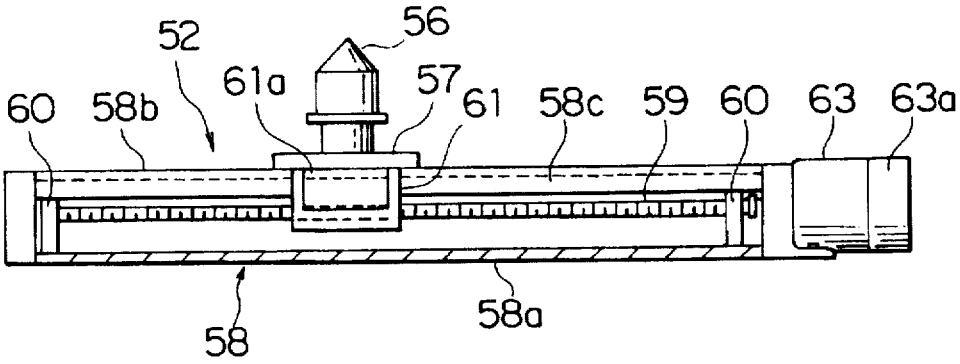
FIG. 8 is a side elevational view showing the slide base apparatus with a portion being broken away.
Figure 9:
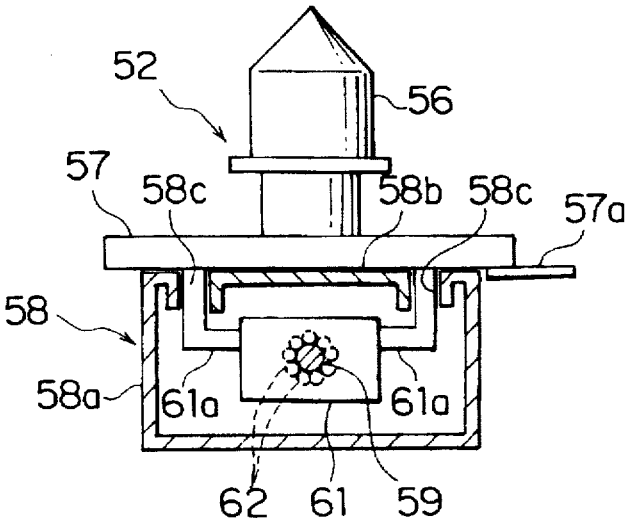
FIG. 9 is a front sectional view of the slide base apparatus.

As is shown in FIG. 7 to 9, a screw rod 59 is rotatably mounted in a housing 58 of the slide base apparatus 52 (53 to 55) with both ends thereof being rotatably supported by bearings 60, wherein a nut member 61 is mounted screwwise on the screw rod 59 with interposition of balls 62 (see FIG. 9) so that the nut member 61 can be moved in the axial direction of the screw rod 59. A reversible electric motor 63 is disposed at one side of the housing 58 and has an output shaft to which one end of the screw rod 59 is connected for corotation with the former. The reversible electric motor 63 is equipped with a brake 63*a*.

The housing 58 is constituted by a box-like member 58*a* having a top opened and a cover plate 58*b* disposed on the opened top of the box-like member 58*a*. Defined below the top surface of the housing 58 between the box-like member 58*a* and the cover plate 58*b* are a pair of guide recesses 58*c* which extend in the longitudinal direction. On the other hand, the nut member 61 is formed with a pair of supporting projections 61*a* at both sides thereof, respectively, wherein each of the supporting projections 61*a* is bent in an L-like form and extends upwardly, so that the supporting projections 61*a* are slideably received within the guide recesses 58*c*, respectively. In this manner, the base plate 57 having the upstanding peg 56 mounted thereon is stably supported by the projections 61*a* at the top ends thereof. Further, a dog 57*a* serving for detection of the position of the base plate 57 is secured to the bottom surface of the base plate 57 at one side thereof and projects outwardly in the horizontal direction. The peg 56 is adapted to move on the top surface of the housing 58 in the direction away from the reversible electric motor 63 when the reversible electric motor 63 is driven in the forward direction, while the peg 56 is moved on the top surface of the housing 58 in the direction toward the reversible electric motor 63 when the reversible electric motor 63 is driven in the backward direction.

The slide base apparatuses 52 and 53 located at the side for receiving the full bobbins FB are each imparted with a function for transferring horizontally the full bobbins FB from the transporting rail 3 to the transporting rail 4. Each of the base plates 57 of the slide base apparatuses 52 and 53 is adapted to be movably and exchangeably positioned at a withdrawing or removing position at which the peg 56 lies immediately below the transporting rail 3 from which the full bobbin FB is to be transferred to the peg 56 and a fitting position lying immediately below the transporting rail 4 to which the bobbin is to be transferred from the peg 56.

On the other hand, each of the slide base apparatuses 54 and 55 located at the side for receiving the full bobbins FB is imparted with a function for transferring the full bobbins FB from the transporting rail 3 to the transporting rail 4 in the horizontal direction. Each of the base plates 57 of the slide base apparatuses 54 and 55 is adapted to be located at a removing or withdrawing position just below the transporting rail 4 at which the empty bobbin EB is to be transferred from the peg 56 to the transporting rail 4 and a fitting position immediately beneath the transporting rail 3 at which the bobbin is to be transferred to the peg 56 from the transporting rail 3. The state shown in FIG. 2 in which the pegs 56 are disposed at the respective removing positions represents the original position for the slide base apparatuses 52 to 55.

Referring to FIG. 2, three position sensors 64, 65 and 66 (shown only in FIG. 2) are mounted on the table 44 along the longitudinal direction of the slide base apparatuses 52 to 55 at positions capable of detecting the dogs 57*a* with substantially equal distance therebetween. More specifically, the position sensor 64 is mounted at a position capable of detecting the dog 57*a* when the peg 56 is disposed at the bobbin withdrawing position, whereas the position sensor 66 is disposed at the position capable of detecting the dog 57*a* when the peg 56 is disposed at the bobbin fitting position. On the other hand, the position sensor 65 is disposed at a position capable of detecting the dog 57*a* when the peg 56 is disposed at an intermediate stop position located at a middle point between the bobbin removing position and the bobbin fitting position.

The reversible electric motor 63 is under the control of the control apparatus C. More specifically, the control apparatus C controls the reversible electric motor 63 on the basis of the detection signals outputted from the position sensors 64, 65 and 66 upon detection of the dog 57*a* so that the peg 56 is stopped at the bobbin removing position (stopping or original position), the middle stop position and the bobbin fitting position, respectively.

As is shown in FIGS. 3 and 4, a pair of proximity sensors 67 and 68 are mounted on the bottom surface of the supporting plate 43*a* in a suspended state at positions corresponding to the tops of the pegs 56 which are disposed at the original positions of the two inner slide base apparatuses 53 and 54. More specifically, the detecting area of the proximity sensor 67 is so established that the bobbin hanger 10 of the bobbin transporting carrier 8 positioned directly above the peg 56 disposed at the original position of the slide base apparatus 53 can be detected. On the other hand, the detecting area or region of the proximity sensor 68 is so established that the bobbin hanger 10 of the bobbin transporting carrier 9 positioned just above the peg 56 disposed at the original position of the slide base apparatus 54 can be detected.

The feed-in and the feed-out of the bobbins B upon bobbin exchanging operation to be performed by the bobbin exchanging apparatus 7 are realized by driving intermittently the feeding apparatus 14*a* disposed on the transporting rails 3 and 4 at front and rear sides of the bobbin exchanging apparatus 7 under the control of the control apparatus C on the basis of the detection signals outputted from the proximity sensors 67 and 68, respectively. More specifically, the control apparatus C responds to the first on-signals supplied from the proximity sensors 67 and 68 to thereby decrease the rotation speed of the motor 28 to a predetermined low speed, while when the proximity sensors 67, 68 are turned on again, the motor 28 is stopped. In other words, every time two bobbin hangers 10 are detected by the proximity sensors 67 and 68, respectively, the motor 28 once driven is stopped. Thus, in the course of the bobbin exchanging operation, the bobbins FB or EB suspended on the bobbin hanger 10 are intermittently fed in (or out) on a two-by-two basis.

In each of the bobbin transporting carriers 8 and 9, dummy dogs (not shown) which can be detected by the proximity sensors 67 and 68 are mounted at leading and trailing ends of the bobbin transporting carriers 8 and 9, respectively, each with a distance relative to the leading and trailing bobbin hangers 10, respectively, of the bobbin hanger row, which distance is equal to the bobbin hanger pitch. Accordingly, when the proximity sensors 67 and 68 detect the dummy dogs at the leading and trailing ends of the bobbin transporting carriers 8 and 9, respectively, the two leading bobbins B are stopped just above the pegs 56 located at the original or start position, while the two trailing bobbin hangers 10 from which two trailing bobbins B have been removed are caused to stop just above the pegs 56 disposed at the respective bobbin fitting positions.

The control apparatus C is provided with counters (not shown) for counting cumulatively the on-signals supplied from the proximity sensors 67 and 68, respectively. Every time the operation for exchanging sixty bobbins has been completed with the counter counting the on-signal from the proximity sensor 67 sixty-two times, the motor 28 for the feeding apparatus 14*a* provided in association with the transporting rail 3 is driven. Further, every time the bobbin exchange operation for one hundred and twenty bobbins has been completed with the counter counting the on-signal outputted from the proximity sensor 68 one hundred and twenty-two times, the motor 28 of the feeding apparatus 14*a* for the transporting rail 4 is driven. At the same time when the motor 28 is driven, the contents of the counters mentioned above are reset.

Disposed on the table 44 in the vicinity of both ends of the slide base apparatuses 52 to 55, respectively, are proximity sensors 69, each of which is imparted with a detection area or region capable of detecting the bobbins B fit onto the pegs 56 located at the removing position (original position) and proximity sensors 70 each imparted with a detection area or region capable of detecting the bobbins B fit onto the pegs 56 located at the bobbin fitting position. The proximity sensors 69 and 70 are actuated at predetermined timings. When it is decided by the control apparatus C on the basis of the on/off signal supplied from the proximity sensors 69 and 70 that some abnormality occurs in respect to the presence/absence of the bobbins B, operations of the bobbin exchanging apparatus 7 as well as the feeding apparatus 14*a* disposed at front and rear sides thereof, respectively, are shut down as emergency stop.

The control apparatus C is adapted to control the operations of the motor 28, the lift motor 47 and the reversible electric motor 63 at predetermined timings on the basis of the detection signals supplied from the position sensors 64 to 66 and the proximity sensors 67 to 70 in accordance with preset control programs.

Figure 5:
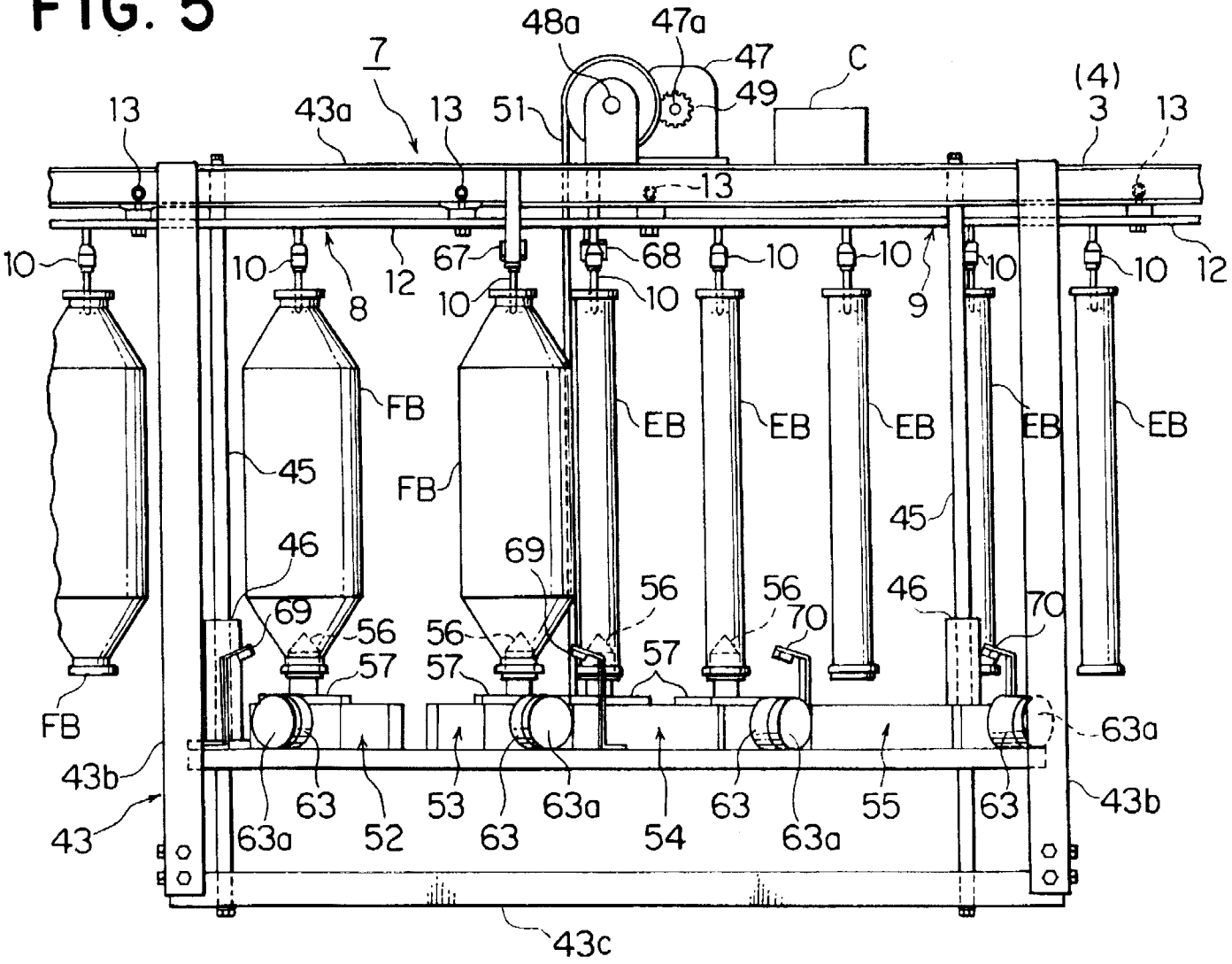
FIG. 5 is a partially broken side elevational view showing the bobbin exchanging apparatus in the state in which the table is at a lifted position.
Figure 6:
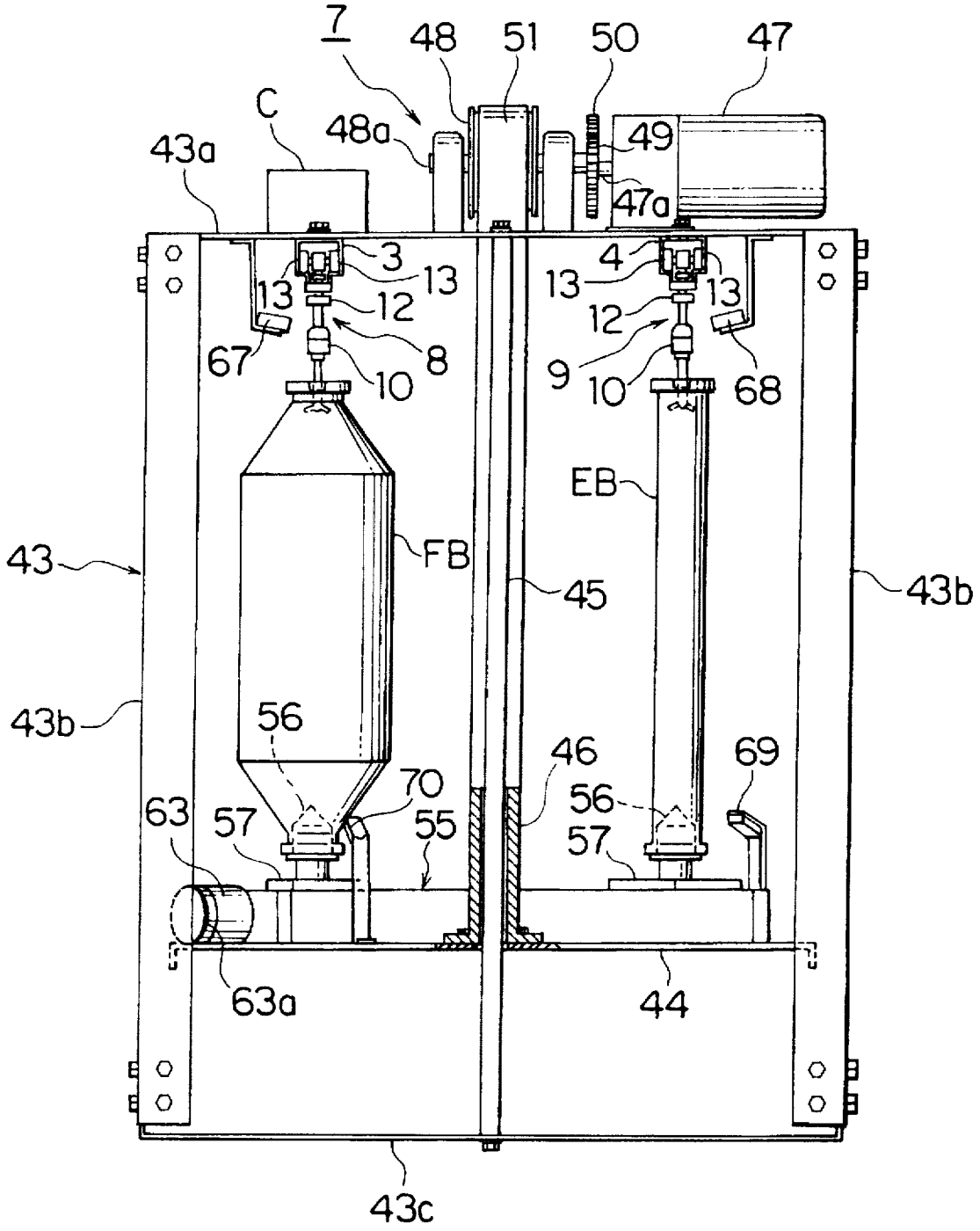
FIG. 6 is a partially broken front view showing the bobbin exchanging apparatus in the state in which the table is at the lifted position.

More specifically, the lift motor 47 is adapted to be driven in both the forward and backward directions only once for a predetermined angular distance so that the table 44 can reciprocatively be moved between the lowered position (i.e., position shown in FIGS. 3 and 4) and the lifted position (shown in FIGS. 5 and 6). At the lifted position shown in FIGS. 5 and 6, the peg 56 disposed at the bobbin removing position (original position) is fit into the socket of the bobbin B disposed just above the peg 56, whereupon the bobbin B is slightly pushed downwardly. Thus, the bobbin B is released from the state retained by the bobbin hanger 10. On the other hand, an upper portion of the bobbin B fit to the peg 56 disposed at the bobbin fitting position is inserted to the bobbin hanger 10 to be thereby retained. In other words, during a period in which the table 44 is reciprocated once between the lowered position and the lifted position thereof, removal and mounting of the bobbin B can be realized.

In the state where the table 44 is disposed at the lowered position, as shown in FIGS. 3 and 4, the bobbins B suspended on the bobbin transporting carriers 8 and 9 can be moved without interfering the pegs 56. Further, the bobbin B fit onto the peg 56 (indicated by broken lines in FIGS. 3 and 4) can be moved together with the peg 56 to the state where the bobbin B is completely withdrawn from the bobbin hanger 10 without engaging the bobbin hanger 10. In this conjunction, it should be mentioned that the bobbin hanger 10 is implemented in such a structure that upon insertion of the bobbin B, the latter is retained by the bobbin hanger 10 and released from the retained state when the bobbin as retained is pushed upwardly by a predetermined distance.

It should further be added that a switch device (not shown) is provided at each of the branching points on the transporting rails 3 and 4, wherein the travelling direction of the bobbin transporting carriers 8 and 9 can be changed to the desired direction by actuating the relevant switch or switches as commanded from the control console CP.

Next, description will be directed to operations of the bobbin exchanging apparatus 7 implemented in the structure described above.

During the operation of the individual flyer frames 1 in the flyer frame array F, a pair of bobbin transporting carriers 8 each having the empty bobbins EB suspended in rows are disposed on the overhead branched transporting rails 3*a* and 3*b*, respectively, at each machine frame. On the other hand, during the operation of the spinning machines 2 in the spinning machine array R, four bobbin transporting carriers 9 each suspending rowwise the full bobbins FB ready for the bobbin exchanges (i.e., the reserve roving bobbins) are located at both left and right sides of each machine in the standby state on the reserve transporting rails 4*a*, 4*a*. In this standby state, operations of the feeding apparatuses 14 on the branched transporting rails 3*a* and 3*b* and the reserve transporting rails 4*a* are inhibited under the control of console CP.

Upon production of the full roving bobbins by a given one of the flyer frame 1 in the flyer frame array F, the cop changer moves at the front side of the given flyer frame 1 intermittently along the longitudinal direction, whereby a plurality of the full roving bobbins FB disposed zigzag or staggered on the bobbin wheels in rows are simultaneously exchanged with a corresponding number of full bobbins FB suspended on the two bobbin transporting carriers 8 waiting for the bobbin exchange service on the branched transporting rails 3*a* and 3*b* supported overhead at the flyer frames 1. More specifically, the two bobbin transporting carriers 8 waiting for the bobbin exchange in the standby state are so disposed that the bobbin hangers 10 suspended rowwise in each of the bobbin transporting carriers 8 are arrayed zigzag or staggered in two rows so as to conform with the array of the bobbin wheels so that the two rows of the full bobbins FB disposed on the bobbin wheels can be mounted on the two bobbin transporting carriers 8, respectively, on a row-by-row basis. On the other hand, in the case where the simultaneous exchange type cop changer is employed, all the full bobbins FB on the bobbin wheels arrayed in the front and rear rows are simultaneously exchanged with all the full bobbins FB suspended on the two bobbin transporting carriers 8. Upon completion of the doffing operation performed by the cop changer or the simultaneous exchange type cop changer, the feeding apparatus 14 provided in association with the branched transporting rails 3*a* and 3*b* is released from the rest state, whereby the two bobbin transporting carriers 8 loaded with the full bobbins FB are caused to travel on and along the transporting rail 3 toward the bobbin exchanging apparatus 7, running around clockwise as viewed in FIG. 1.

On the other hand, when the roving bobbins suspended on the creel of a given one of the spinning machines 2 in the spinning machine array R come close to the empty state, a pair of roving bobbin exchanging apparatuses are dispatched to the given spinning machine 2 to exchange simultaneously a plurality of the empty bobbins EB with a corresponding number of full bobbins FB suspended on the four bobbin transporting carriers 9 waiting for the bobbin exchange service on the reserve transporting rail 4*a*, respectively, by moving intermittently at both sides of the given spinning machine 2 in the longitudinal direction thereof.

Upon completion of the roving bobbin exchanging operation carried out by the roving bobbin exchanging apparatus, the feeding apparatus 14 provided in association with the reserve transporting rails 4*a* is released from the stationary state, as a result of which the four bobbin transporting carriers 9 suspending thereon the empty bobbins EB are caused to move sequentially from the reserve transporting rail 4*a* to the transporting rail 4 and hence to the loop path disposed adjacent to the spinning machine array R. In succession, the bobbin transporting carriers 9 travel around in the clockwise direction as viewed in FIG. 1 along the loop path. In the course of travelling along the loop path, the residual rovings on the empty bobbins are removed perfectly through cooperation of the ARS device 5 and the cutting device 6. The bobbin transporting carriers 9 suspending the empty bobbins EB completely free of the residual rovings are transported into the bobbin exchanging apparatus 7.

At this juncture, the thrust or driving force for allowing the bobbin transporting carriers 8 and 9 on the transporting rails 3 and 4 to move is available from the feeding apparatuses 14 and 14*a* disposed along the transporting rails 3 and 4 at an interval which is shorter than the overall lengths of the bobbin transporting carriers 8 and 9, respectively.

When a bobbin transporting carrier 8 or 9 is in the standby state under the control of the control console CP, a portion of the link member 12 is gripped, being sandwiched, between the rollers 21, 22 of the feeding apparatus 14 and the belt 20. When the motor 28 is driven upon releasing of the stopped state, the belt 20 is caused to move around, whereby a driving force is transmitted to the link member 12 from the belt 20 via a contact surface thereof and acts as the thrust or driving force for allowing the bobbin transporting carrier 8 or 9 to run. To this end, the link member 12 is brought into contact with a wide surface area of the belt 20 extending substantially over a distance between the axial centers of the pulleys 18 and 19. Thus, there can be ensured adequate contacting surface. Consequently, there will take place no slippage between the link member 12 and the belt 20 even in the state applied with a relatively heavy load due to a large number of the bobbins FB, EB as suspended, whereby the rotating efforts of the belt 20 can positively be transmitted to the link member 12 for moving the bobbin transporting carriers 8 and 9, which thus can smoothly start the travel.

Before the rear end portion of the bobbin transporting carrier 8, 9 is released from the engagement with the feeding apparatus 14, the leading end of the bobbin transporting carrier 8, 9, as viewed in the travelling or running direction, arrives at the succeeding feeding apparatus 14. Before the bobbin transporting carrier 8, 9 arrives at the succeeding feeding apparatus 14, the rollers 21 and 22 of the feeding apparatus 14 are resiliently urged toward the belt 20 under the influence of the spring 38 and held in the state in opposition to the belt 20 with a gap therebetween, which gap is slightly shorter than the width of the link member 12, as can be seen in FIGS. 11 and 12. In this state, the proximity sensors 40 and 41 detect the rear end surfaces of the arms 32*b* and 33*b*, respectively, to be thereby set to the off-state. Thus, the motor 28 remains stationary.

Figure 13:
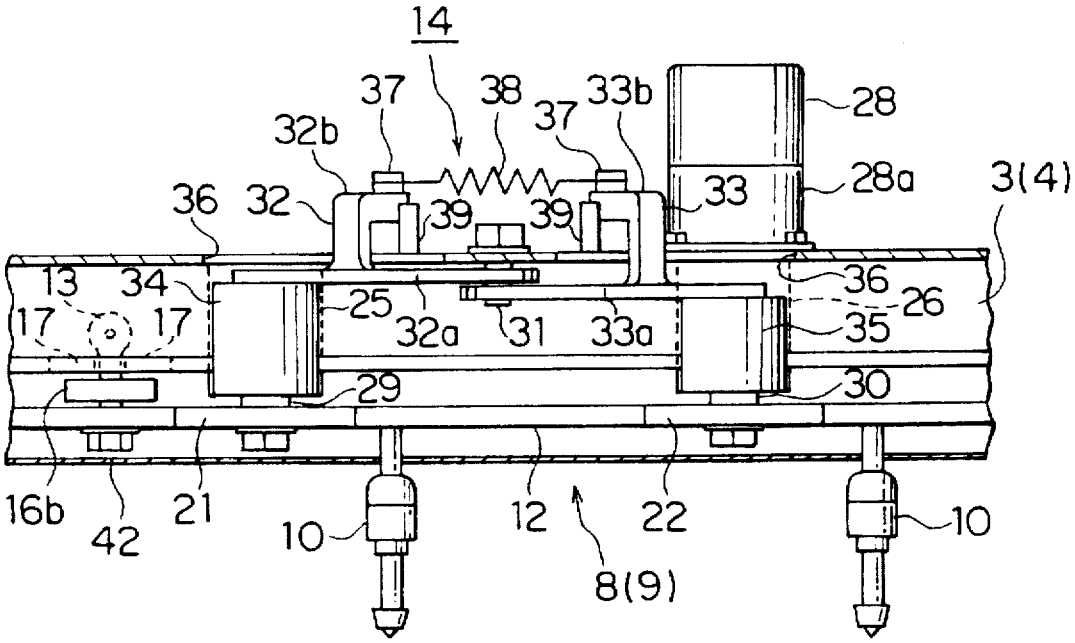
FIG. 13 shows a side elevational section of the feeding apparatus.
Figure 14:
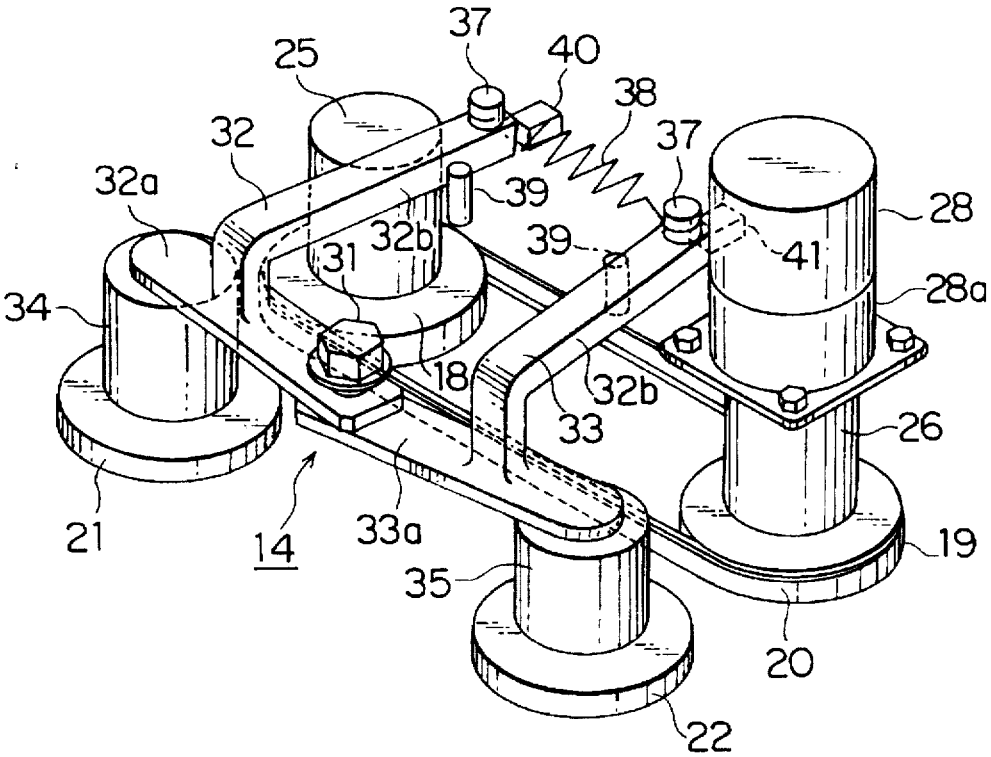
FIG. 14 is a perspective view of the same.

Now, assuming that the bobbin transporting carrier 8, 9 approaches closer to the feeding apparatus 14 from the left-hand side, as viewed in FIGS. 11 to 13, a tip end portion of the link member 12 intrudes the gap between the rollers 21 and 22 against the resilient force of the spring 38 while pushing away sequentially the rollers 21 and 22. In that case, the arm lever 32 is caused to rotate at first to thereby turn on the proximity sensor 40, as a result of which the motor 28 is driven forwardly to cause the pulley 19 to rotate in the direction indicated by an arrow A in FIG. 11. Consequently, the belt 20 moves around in the clockwise direction, as viewed in FIG. 11, whereby a thrust is imparted to the link member 12 in the travelling direction.

On the other hand, in case the bobbin transporting carrier 8, 9 is coming closer to the feeding apparatus 14 from the right-hand side, as viewed in FIGS. 11 to 13, the tip end portion of the link member 12 intrudes the gap defined between the rollers 21and 22 against the force of the spring 38 while pushing away sequentially the rollers 21 and 22. In that case, the roller 22 is first pushed away to thereby turn on the proximity sensor 41, as a result of which the motor 28 is driven backwardly to cause the pulley 19 to rotate in the direction indicated by an arrow B in FIG. 11. Consequently, the belt 20 moves around in the counterclockwise direction, as viewed in FIG. 11, whereby a thrust is imparted to the link member 2 in the corresponding travelling direction.

In this conjunction, it is to be noted that because the driving member for transmitting the thrust is constituted by the belt 20, whereby a large contacting surface can be assured for the link member 12, there may arise no slippage between the belt 20 and the link member 12. Thus, the revolving force of the belt 20 can be transmitted to the link member 12 with high reliability, even when the bobbin transporting carrier 8, 9 is in the running state.

Each of the bobbin transporting carriers 8 and 9 travels to the bobbin exchanging apparatus 7 under the action of the thrusts received from the associated feeding apparatuses 14 and 14*a*, respectively, whereby the bobbin transporting carriers 8 and 9 enter the bobbin exchanging apparatus 7, passing by each other, from the opposite sides thereof, respectively. More specifically, the bobbin transporting carrier 8 carrying the full bobbins FB in the suspended state is transported into the bobbin exchanging apparatus 7 along the transporting rail 3 from the left-hand side as viewed in FIGS. 1 and 2, while the bobbin transporting carrier 9 carrying the suspended empty bobbins EB is transported into the bobbin exchanging apparatus 7 from the right-hand side as viewed in the same figures. At this time point, the slide base apparatuses 52 to 55 of the bobbin exchanging apparatus 7 are disposed at the original position with the pegs 56 being set to the respective withdrawing positions, while the table 44 is in the lowered state.

The bobbin transporting carriers 8 and 9 are transported into the bobbin exchanging apparatus 7 under the action of the thrusts received from the feeding apparatuses 14*a* installed in precedence and in succession to the bobbin exchanging apparatus 7, respectively. The motor 28 of the feeding apparatus 14*a* is controlled by the control apparatus C. In the course of operation of the motor 28, the motor 28 is decelerated in response to a first output signal from the proximity sensors 67, 68 under the control of the control apparatus C and caused to stop in response to a second output signal of the proximity sensors 67, 68.

By virtue of the arrangement described above, the bobbin transporting carrier 8 entering the bobbin exchanging apparatus 7 from the left-hand side, as viewed in FIG. 3, is decelerated upon detection of the dog provided at the leading end portion of the bobbin transporting carrier 8 by means of the proximity sensor 67 and caused to stop upon succeeding detection of the bobbin hanger 10 located at the most advanced position, as viewed in the travelling direction of the bobbin transporting carrier 8. As a result of this, the leading two full bobbins FB suspended on the bobbin transporting carrier 8 are disposed just above the pegs 56 disposed at the original positions of the slide base apparatuses 52 and 53, respectively, as can be seen in FIG. 3.

On the other hand, the bobbin transporting carrier 9 entering the bobbin exchanging apparatus 7 from the right-hand side, as viewed in FIG. 3, is decelerated upon detection of the dog provided at the leading end portion of the bobbin transporting carrier 9 by means of the proximity sensor 68 and caused to stop upon succeeding detection of the bobbin hanger 10 located at the most advanced position, as viewed in the travelling direction of the bobbin transporting carrier 9. As a result of this, the leading two empty bobbins EB suspended on the bobbin transporting carrier 9 are disposed immediately above the pegs 56 disposed at the original positions of the slide base apparatuses 54 and 55, respectively, as can be seen in FIG. 3.

When the two full bobbins FB and the two empty bobbins EB which are to be exchanged with each other have been positioned immediately above the pegs 56 disposed at the original positions of the slide base apparatuses 52 to 55, the proximity sensors 67 and 68 output twice the detection signals, respectively, in response to which the lift motor 47 is reciprocatively driven forwardly and reversely once over a predetermined angular range. Thus, the drum 48 is caused to rotate reciprocatively at a speed reduced through the gear train 49, 50 resulting in that the metal belt 51 is wound up and then delivered, to thereby cause the table 44 to move reciprocatively once between the lowered position shown in FIGS. 3 and 4 and the lifted position shown in FIGS. 5 and 6.

Upon lifting or upward movement of the table 44, the pegs 56 disposed at the respective withdrawing or removing positions (original or starting positions) are fit into the bottom of the full bobbins FB and the empty bobbins EB, which are thus slightly pushed upwardly by the respective pegs 56, whereby these bobbins are released from the state retained by the respective bobbin hangers 10. Thus, upon lowering of the table 44, the full bobbins FB and the empty bobbins EB fit on the pegs 56, respectively, are withdrawn or extracted from the respective bobbin hangers 10 and lowered to the position indicated by broken lines in FIGS. 3 and 4.

In the course of the lift/lowering process described above, the proximity sensors 69 provided at the withdrawing position (original position) are activated, which is then followed by turning-on of the proximity sensors 69 at the lifted position, whereby the presence of the suspended full bobbins FB and the empty bobbins EB can be confirmed on the basis of the signals outputted from the proximity sensors 69. Furthermore, when the detection signal outputted from the proximity sensors 69 continues to exist even at the lowered position, this means that the full bobbins FB and the empty bobbins EB have been pulled out without fail. By contrast, where any one of the proximity sensors 69 is in the off-state at the lifted position or when all the proximity sensors 69 are once turned on at the lifted position and when any one of the proximity sensors 69 is turned off at the lowered position, the bobbin exchanging apparatus 7 and the feeding apparatus 14*a* are stopped, whereupon a corresponding emergency alarm is issued.

When the removals of the full bobbins FB and the empty bobbins EB to be exchanged have been completed and when all the proximity sensors 69 are in the on-state, the reversible electric motors 63 provided in association with the slide base apparatuses 52 to 55, respectively, are driven under control of the control apparatus C, whereby the full bobbins FB and the empty bobbins EB are transferred from the respective bobbin withdrawing positions to the fitting positions, respectively. In parallel with this transfer process, the motor 28 for the feeding apparatus 14*a* is driven under the control.

Next, referring to FIG. 17, description will be made in detail of the driving control involved in effectuating the transfer process mentioned above. Parenthetically, in FIG. 17, the brake 63*a* is omitted from illustration.

When all the proximity sensors 69 are in the on-state upon completion of the removal of the full bobbins FB and the empty bobbins EB, the reversible electric motors 63 are driven to thereby allow the associated base plates 57 having the upstanding pegs 56 mounted thereof to start to move from the withdrawing position toward the fitting position in the direction indicted by an arrow in FIG. 17(*a*). Consequently, the full bobbins FB are transported from the transporting rail 3 toward the transporting rail 4, while the empty bobbins EB are transported from the transporting rail 4 toward the transporting rail 3. In the meanwhile, the position sensor 65 (shown in FIG. 2) is actuated.

On the way of the base plate 57 moving toward the fitting position, when the dog 57*a* is detected by the position sensor 65 which is thereby turned on, the reversible electric motor 63 is immediately stopped, whereby the base plate 57 is caused to stop at an intermediate stop position shown in FIG. 17(*b*) which is located intermediate between the withdrawing position and the fitting position. As a consequence, the full bobbins FB and the empty bobbins EB are caused to stop at the position intermediate between the transporting rails 3 and 4.

The motor 28 of the feeding apparatus 14*a* is driven in response to the turn-on of the position sensor 65, whereupon the bobbin transporting carriers 8 and 9 start to move in the direction indicated by arrow in FIG. 17(*b*). Thereafter, the proximity sensors 67, 68 are turned on. Then, the motor 28 is controlled to be decelerated, which results in corresponding lowering of the moving speed of the bobbin transporting carriers 8 and 9. Upon detection of the succeeding bobbin hanger 10, the proximity sensors 67 and 68 are turned on once again. At this time, the motor 28 is stopped. Thus, the bobbin transporting carriers 8 and 9 are caused to stop in the state where they have been advanced by two pitches of the respective bobbin hangers 10. This state is illustrated in FIG. 17(*c*). In this way, those bobbin hangers 10 from which the full bobbins FB and the empty bobbins EB to be exchanged have been removed are disposed immediately above the withdrawing positions to which the base plates 57 are destined to move, as can be seen in FIG. 17(*c*).

In response to the second turning-on of the proximity sensors 67 and 68, the reversible electric motor 63 is driven again to allow the associated base plates 57 to start to move from the intermediate stop position toward the fitting position in the direction indicated by arrows in FIG. 17(*c*). At this time point, the position sensor 66 (shown in FIG. 2) is actuated.

When the position sensor 66 is turned on upon detection of the dog 57*a* of the associated base plate 57, the corresponding motor 63 is immediately stopped, whereby the base plate 57 is caused to stop at the associated fitting position. Thus, the full bobbins FB and the empty bobbins EB are disposed at the respective fitting positions, wherein the bobbin hangers 10 from which the empty bobbins EB have been removed are disposed just above the full bobbins FB, respectively, while the bobbin hangers 10 from which the full bobbins FB have been removed are disposed just above the empty bobbins EB, respectively.

When all of the position sensors 66 (shown in FIG. 2) are turned on indicating that the full-bobbins FB and the empty bobbins EB have been transported to the respective fitting positions, the lift motor 47 is driven to move the table 44 reciprocatively once between the lowered position and the lifted position.

In this case, when the table 44 is disposed at the lifted position, the full bobbins FB and the empty bobbins EB disposed at the respective fitting positions, being mounted on the pegs respectively, are retained by the bobbin hangers 10 located just above the full bobbins FB and the empty bobbins EB and inserted to top portions thereof, respectively. Thus, upon lowering of the table 44, the pegs 56 get free of the full bobbins FB and the empty bobbins EB. To say in another way, solely the pegs 56 are moved downwardly to the lowered position.

In the course of the lifting and lowering process, the proximity sensors 70 disposed at the side of the bobbin fitting position are actuated and turned off at the lowered position upon completion of one cycle of lifting and lowering motion. In other words, when the proximity sensors 70 are all turned off at the lowered position, this indicates that all the full bobbins FB and the empty bobbins EB have been fit on the respective bobbin hangers without fail. On the other hand, when any one of the proximity sensors 70 is in the on-state at the lowered position, this event is recognized as indicating occurrence of a failure in fitting the corresponding one of bobbins FB and EB, whereby emergency stop of the bobbin exchanging apparatus 7 and the feeding apparatus 14*a* is validated with a corresponding alarm being generated.

When all the proximity sensors 70 are in the off-state at the lowered position, the reversible electric motor 63 for the slide base apparatuses 52 to 55 are driven to move back the respective base plates 57 from the fitting position to the withdrawing or original position. At that time, the position sensors 64 are actuated. Upon detection of the dogs 57*a* of the base plates 57 by the position sensors 64, driving operations of the reversible electric motor 63 are instantly stopped, as a result of which the base plates 57 are stopped at the respective original positions at which the pegs 56 are located immediately beneath the transporting rails 3 and 4. Upon completion of one cycle operation of the bobbin exchanging apparatus 7 and the feeding apparatus 14*a* under the control of the control apparatus C in this manner, two full bobbins FB of the bobbin transporting carrier 8 and the two empty bobbins EB of the bobbin transporting carrier 9 have been mounted on the bobbin hangers 10 of the counterpart bobbin transporting carriers at which the full bobbins FB and the empty bobbins EB were once suspended, respectively. In this manner, exchange of the bobbins has been accomplished with inter-bobbin distances conforming to the pitches at the counterpart bobbin transporting carriers, respectively.

Upon completion of the one cycle operation described so far, the full bobbins FB and the empty bobbins EB which are next to be exchanged are disposed at positions immediately above the individual pegs 56, respectively, which are disposed at the respective original positions. When the first one cycle of operations has been completed, the control apparatus C starts a next or succeeding cycle of operations, beginning with the lifting/lowering operation of the table 44 located at the original position. By repeating the cycle operation successively, the full bobbins FB and the empty bobbins EB are exchanged on a two-by-two two basis between the bobbin transporting carriers 8 and 9 which differ from each other in respect to the bobbin hanger pitch.

The control apparatus C incorporates therein counters for counting cumulatively the on-signals issued from the proximity sensors 67 and 68. Every time the counter counts the on-signal from the proximity sensor 67 sixty-two times, indicating that the bobbin exchanging operation for a given one of the bobbin transporting carriers 8 (carrying sixty bobbins) has been completed, the motor 28 for the feeding apparatus 14*a* installed in association with the transporting rail 3 is driven. Thus, at the same time the bobbin transporting carrier 8 for which the bobbin exchanging operation has been completed for all the bobbins carried thereby, two leading full bobbins FB of a succeeding bobbin transporting carrier 8 are disposed immediately above the withdrawing positions, respectively. Starting from this state, the bobbin exchanging operation elucidated previously is repeated, whereby one hundred and twenty full bobbins and a same number of the empty bobbins are mutually exchanged between the two bobbin transporting carriers 8 and the one bobbin transporting carrier 9.

Upon every completion of the bobbin exchanging operation for one bobbin transporting carrier 9 (carrying one hundred and twenty bobbins), as indicated by the counter having counted the on-signal from the proximity sensor 68 one hundred and twenty-two times, the motor 28 provided for the feeding apparatus 14*a* installed in association with the transporting rail 4 is driven to expel the bobbin transporting carrier 9 undergone the bobbin exchange completely from the bobbin exchanging apparatus 7. In the case where the bobbin transporting carriers 9 is transported into the bobbin exchanging apparatus 7 successively without interruption, two leading full bobbins FB of the succeeding bobbin transporting carrier 8 are disposed immediately above the withdrawing position at the same time the bobbin transporting carrier 9 is fed out from the bobbin exchanging apparatus 7. In this way, when both the bobbin transporting carriers 8 and 9 are transported into the bobbin exchanging apparatus 7 successively without interruption, the bobbin exchange operations performed by the bobbin exchanging apparatus 7 are continuously carried out. At this junction it is to be noted that when the bobbin transporting carriers 8 and 9 are stopped upon detection of the dogs provided at the rear ends of the bobbin transporting carriers 8 and 9, the two trailing bobbins FB and EB to be exchanged finally are disposed immediately above the fitting positions, respectively.

After leaving the bobbin exchanging apparatus 7, the bobbin transporting carrier 8 travels around on and along the transporting rail 3 to the corresponding flyer frame 1 and is transported to the branched transporting rail 3*a*, 3*b*, whereon the empty bobbins EB fed back from the spinning machine is supplied to the relevant flyer frame 1.

On the other hand, the bobbin transporting carrier 9 fed out from the bobbin exchanging apparatus 7 is placed in the temporary standby state on the pool line section 4*c*, so as to cope with the full bobbin supply demand of the spinning machines 2, as occasion requires. When a given one of the spinning machines 2 issues a demand for supply of the full bobbins FB, the bobbin transporting carriers 9 standing by on the pool line section 4*c* are dispatched to the full bobbin requesting spinning machine 2 on and along the transporting rail 4 to be moved onto the reserve transporting rail 4*a* disposed at both sides of the spinning machine 2, respectively, whereby reserve roving bobbins are supplied thereto. In this manner, the full bobbins FB manufactured by the flyer frames 1 are transported to the spinning machine array R, while the empty bobbins EB whose rovings have be consumed by the spinning machines 2 are transported back to the flyer frame array F.

As will now be appreciated from the foregoing description, in the bobbin transporting system according to the instant embodiment of the present invention, the bobbin transporting carriers 8 and 9 are caused to run or travel on and along the transporting rails 3 and 4 which are independent of each other, wherein the pitch at which the bobbin hangers 10 are suspended on the bobbin transporting carrier 8 coincides with the pitch of the bobbin wheels of the flyer frame 1. Thus, the cop changing or doffing operation can be performed in the state in which the zigzag (staggered) disposition pattern in two rows is maintained. In this manner, the bobbin exchanging operation performed by the cop changer is simplified whereby the cop changer as employed can be implemented in a relatively simple structure. Moreover, when compared with the structure of the conventional cop changer known heretofore (such as disclosed in Japanese Unexamined Patent Application Publication No. 174432/1986 (JP-A-61-174432), the cost for equipment can be reduced while the frequency at which the erroneous cop changing operation takes place can be suppressed to minimum.

Furthermore, because the supporting members of the bobbin transporting carrier are not arrayed in zigzag pattern, as in the case of the apparatus disclosed in Japanese Unexamined Patent Application Publication No. 197376/1986 (JP-A-61-197376), the feeding apparatuses 14 and 14*a* for imparting the thrust to the bobbin transporting carriers 8 and 9 in a relaying fashion can be adopted in the bobbin transporting system according to the instant embodiment of the present invention. Besides, the number of the rollers as well as that of the bearings therefor can be decreased when compared with the conventional bobbin transporting carrier. Further, the structure can be simplified. Thus, even in the case where a greater number of the bobbin transporting carriers 8 and 9 are employed in the bobbin transporting system as compared with the conventional one, the cost involved in installation of the bobbin transporting carriers 8 and 9 can be suppressed to a possible minimum.

Additionally, because the transporting rail 3 is installed overhead so as to extend in continuation through the positions corresponding to the flyer frames and because two bobbin exchanging apparatuses 7 are provided for each of the flyer frames so as to be used in common to the individual bobbin transporting carriers 8, the number of the bobbin exchange apparatuses 7 to be installed can be suppressed to a minimum although it depends on the processing capability of each bobbin exchanging apparatus 7. Besides, since neither the empty bobbins nor the full bobbins can pass by the machine frame in front thereof during the transportation of the doffed full bobbins, differing from the apparatus disclosed in Japanese Unexamined Patent Application Publication No. 6122/1988 (JP-A-63-6122), the bobbin transportation in the doffing phase can be performed by allowing the overhead space to be effectively utilized by the bobbin transporting carrier 8 running on the transporting rail 3. Thus, operation for correcting error of automatic roving winding as well as for repairing the broken roving upon restarting of the flyer frame can be realized substantially without encountering any obstacle.

Because the bobbin transporting carriers 8 and 9 are not used in common by the flyer frame 1 and the spinning machine 2 but are so arranged as to run on and along the respective transporting rails 3 and 4, independent of each other, complicated traffic of the bobbin transporting carriers 8 and 9 can be reduced when compared with the system where the bobbin transporting carriers 8 and 9 are employed in common, whereby the traffic control as well as the waiting or standby times of the bobbin transporting carriers 8 and 9 due to the traffic control tan significantly be reduced. Further, because the bobbin transporting carriers 8 and 9 are used independently in the flyer frame 1 and the spinning machine 2, the number of the bobbin hangers 10 supported in the suspended state can be selected independently for the flyer frame and the spinning machine. Thus, the bobbin exchanging apparatus according to the instant embodiment of the present invention can easily be applied to such system in which the number of bobbins in the spinning machine is not equal to an integral multiple of the number of bobbins in the flyer frame 1. Moreover, due to the arrangement in which the bobbin transporting carriers 8 and 9 differing from each other in respect to the number of the suspended bobbin hangers 10 can travel on and along the same transporting rail 3, 4 in coexistence, the flyer frame and the spinning machine which differ from each other in respect to the number of bobbins can be incorporated in the flyer frame array F and/or spinning machine array R for realizing the bobbin transporting system contemplated by the invention.

In addition, because the transporting rail 3 is so installed in continuation that the bobbin transporting carrier 8 can travel overhead around all the flyer frames 1, the bobbin exchanging apparatus 7 can be used in common by all the bobbin transporting carriers 8 disposed on the transporting rail 3. Thus, the number of the bobbin exchange apparatuses 7 to be installed can be decreased to a minimum although it depends on the number of the bobbin exchanging apparatuses 7 as installed and the processing capability thereof. Additionally, because the bobbin exchanging apparatus 7 is installed on the path of closed loops of the transporting rails 3 and 4, respectively, so that the bobbin transporting carriers 8 and 9 need not be moved backwardly, the bobbin transporting carriers 8 and 9 fed out from the bobbin exchanging apparatus 7 can travel straightforwardly to the respective destinations for transportation of the bobbins FB and EB. Thus, the bobbin transporting carriers 8 and 9 can successively feed into the bobbin exchanging apparatus 7 without interruption, which in turn means that the bobbin exchanging apparatus 7 can continuously perform the bobbin exchanging operations in succession without discontinuation, whereby the operation efficiency of the bobbin exchanging apparatus 7 can significantly be enhanced.

Moreover, by virtue of such arrangement that two bobbin transporting carriers 8 which are in the state ready for exchange of the full bobbins FB formed by the flyer frame 1 and one bobbin transporting carrier 9 are subjected to the bobbin exchanging operation, the bobbin exchanging operation can be continuously or successively be performed between the two bobbin transporting carriers 9 and one bobbin transporting carrier 8 transported into the bobbin exchanging apparatus 7. Thus, because the full bobbins FB produced by the flyer frame can be accommodated by the one bobbin transporting carrier 9, the full bobbins FB manufactured by the flyer frames can be delivered to the spinning machines at an earlier stage.

As described hereinbefore, the bobbin transporting carriers 8 and 9 are caused to travel solely, i.e., independent of each other under the thrusts applied from the feeding apparatuses 14 in a relaying fashion. Owing to this arrangement, the time for waiting for the carrier can considerably be shortened when compared with the conventional system where the bobbin transporting carriers 8 and 9 are pulled by a conveyor. Besides, because the dead span for moving back the bobbin carrier once after it has passed through the inlet completely upon transporting of the bobbin carrier from the distal end so that the conveyor mechanism can get free of the bobbin carrier is rendered unnecessary with the rail space provided conventionally for changing the receiving route being rendered unnecessary. Thus, when compared with the conveyor traction system, the transporting rails 3 and 4 can relatively be shortened, to another advantage.

Because the bobbin exchanging operation of the bobbin exchanging apparatus 7 can be realized by repeating only two simple operations, i.e., the linear movement of the pegs 56 between the bobbin withdrawing position and the bobbin fitting position and up/down motion of the pegs 56 between the withdrawing position and the fitting position, the driving mechanism required to this end can much be simplified, which of course leads to simplification of the structure of the bobbin exchanging apparatus 7.

Furthermore, because the driving force transmitting source provided for the feeding apparatuses 14 and 14*a* is implemented by the belt 20, the link member 12 can be gripped by the belt 20 over the contacting surface area substantially extending over the distance between the axial centers of the pulleys 18 and 19, the driving force can be transmitted to the link member 12 by way of the large contacting surface with very high efficiency without being accompanied with any appreciable slippage. Consequently, for a same driving force or power of the belt 20, the thrust or driving power of greater magnitude can be imparted to the link members 12, whereby the bobbin transporting carriers 8 and 9 can be transported under the action of large thrust even when a great number of bobbins have to be transported once and thus large load is imposed to the bobbin transporting carriers 8 and 9. In particular, a relatively large thrust-driving force is required for starting the bobbin transporting carriers 8 and 9. Even in that case, the bobbin transporting carries 8 and 9 can be started smoothly owing to a large thrust imparted from the feeding apparatus 14, 14*a*.

Embodiment 2

Next, a second embodiment incarnating the invention will be described by reference to FIG. 18. The bobbin transporting system according to the instant embodiment differs from the system of the first embodiment in that the bobbin exchanging apparatus 7 is installed each for a group of flyer frames which are destined to produce same type products (i.e., same type rovings), wherein the products or rovings differ from one to another group of the flyer frames.

Figure 18:
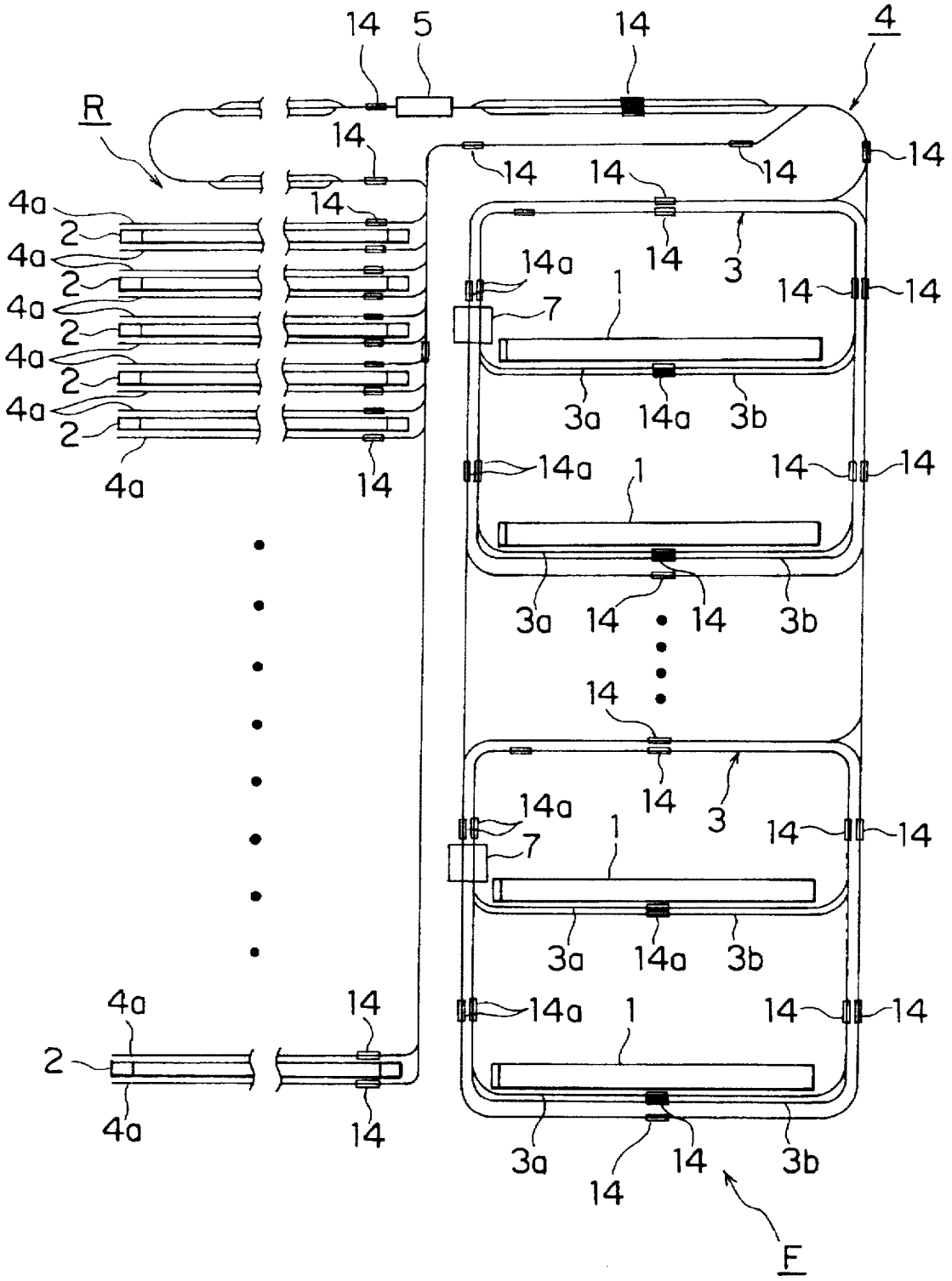
FIG. 18 is a plan view of a bobbin transporting system according to a second embodiment of the present invention.

Referring to FIG. 18, in the flyer frame array F, the sort or grade of the rovings as manufactured differs from one group of the flyer frames 1 to another group thereof, wherein the overhead transporting rails 3 are provided independently on a group-by-group basis. In the case of the system now under consideration, the flyer frames 1 destined for manufacturing same type products are classified into groups, respectively, on a two-by-two basis, wherein each transporting rails 3 constitutes a closed loop including the branched transporting rails 3*a* and 3*b* installed overhead at the front side of the two flyer frames 1, respectively, which are encircled by the transporting rail 3. On the other hand, the overhead transporting rail 4 extends to a position corresponding to the bobbin exchanging apparatus 7 and forms a loop path which extends substantially in parallel with each transporting rail 3 located peripherally inside of the transporting rail 4 and continues to the transporting rail 3.

The bobbin exchanging apparatus 7 is provided for each of the groups of the flyer frames and installed, straddling over the transporting rail 3 and the rail 4 encircling the rail 3. Further, disposed transitably on each of the transporting rails 3 are four bobbin transporting carriers 8 in total, wherein two bobbin transporting carriers 8 are allocated to each of the flyer frames 1 for the service thereof.

Reference should now be had to FIG. 18 which shows only those elements of the bobbin transporting system that differ from the system described with reference to FIGS. 1 to 17. In all other respects the system in FIG. 18 is the same as that previously described.

The bobbin transporting carrier 8 suspending the full bobbins FB transferred from the flyer frame 1 after cop changing operation is adapted to travel on and along the transporting rail 3 in the counterclockwise direction as viewed in FIG. 18. On the other hand, the bobbin transporting carrier 9 suspending the empty bobbins EB whose rovings have been spent in a spinning machine 2 travels on and along the transporting rail 4 to the position corresponding to the flyer frame array F to be transited to the loop path formed by a predetermined transporting rail 3 and travels therealong in the clockwise direction as viewed in FIG. 18.

The bobbin transporting carrier 9 supporting empty bobbins EB that have undergone the residual roving removal processing by the ARS device 5 travels to the position corresponding to the flyer frame array F and runs on the loop in the clockwise direction, as viewed in FIG. 18, which loop corresponds to the transporting rail 3 encircling the flyer frames 1 destined to manufacture the rovings of the same sort as those dispensed from the empty bobbins EB carried by the bobbin transporting carrier 9. On the other hand, in the flyer frame array F, when the flyer frame 1 reaches the full-bobbin state, a predetermined number of the full bobbins FB supported on the bobbin wheels, respectively, are simultaneously exchanged with a corresponding number of the empty bobbins EB suspended on the two bobbin transporting carriers 8 disposed overhead in the standby state by the cop changer running intermittently in front of the machine frames. In this way, the simultaneous bobbin exchange is repetitively performed for a predetermined number of the bobbins until completion of the exchange of all the bobbins. The bobbin transporting carrier 8 suspending now the full bobbins FB after the cop changing operation travels from the branched transporting rail 3*a*, 3*b* to the transporting rail 3 in the counterclockwise direction as viewed in FIG. 18. When the bobbin transporting carriers 8 and 9 are transported into the bobbin exchanging apparatus 7 from both sides thereof, the bobbin transporting carriers 8 and 9 are caused to move intermittently in the opposite directions, respectively, while exchanging sequentially on a two-by-two basis the full bobbins FB and the empty bobbins EB which belong to the same group of the flyer frames. Thus, the bobbin exchange between the full bobbins FB and the empty bobbins EB for the same type rovings can be carried out without fail, while preventing the bobbins of the different type rovings from being mixed.

Although the invention has been described in conjunction with what is presently considered as preferred embodiments, it should be understood that various modifications or versions thereof may be resorted to without departing the spirit and scope of the invention, as described below.

Figure 19:
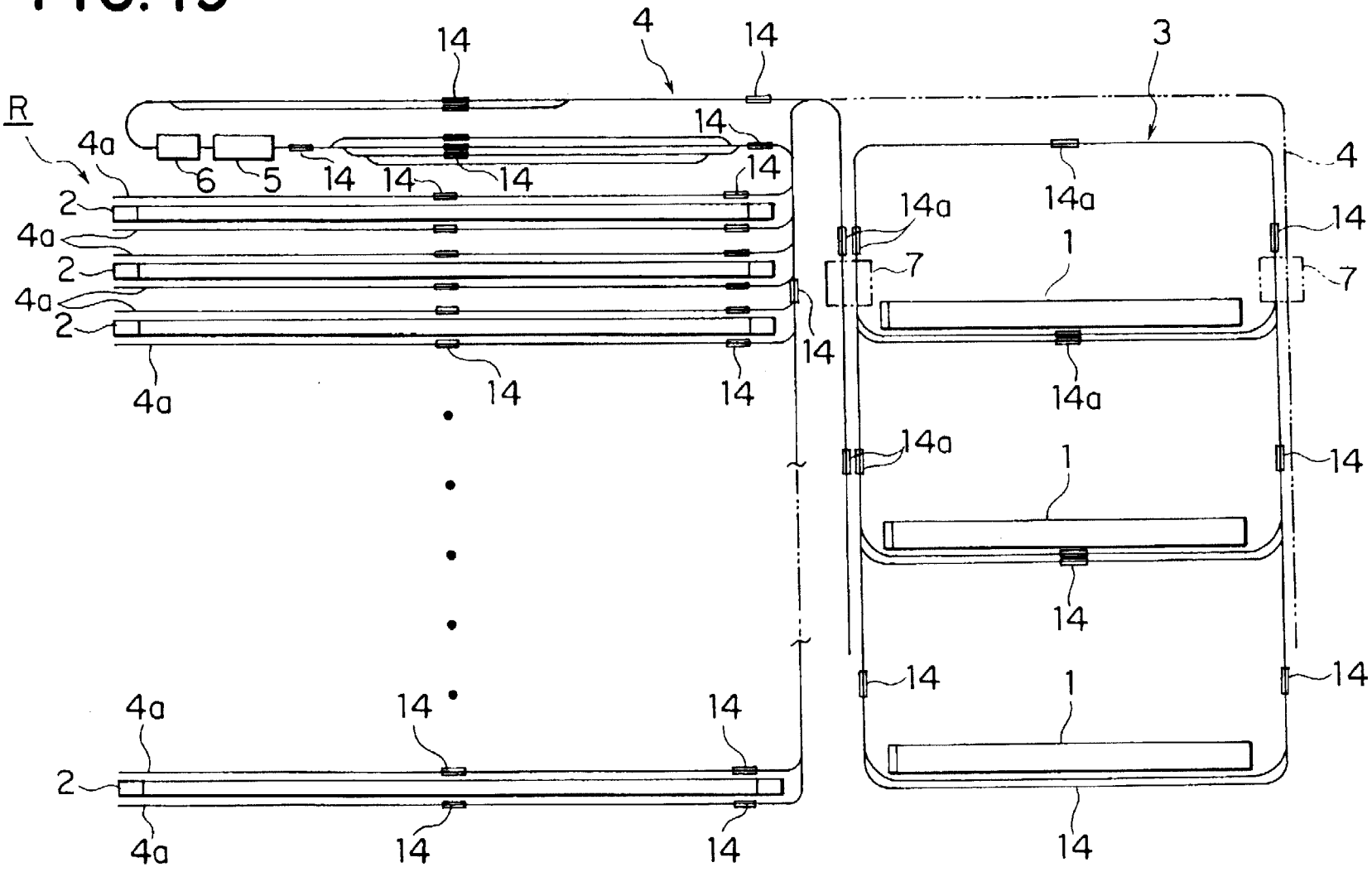
FIG. 19 is a plan view of a bobbin transporting system according to the another embodiment of the invention.

(1) The layout of the transporting rails 3 and 4 is never restricted to those of the embodiments illustrated and described above. By way of example, such layout as shown in FIG. 19 may equally be adopted, in which the transporting rail 4 extends in parallel closely to lateral sections of the transporting rail 3, wherein the bobbin exchange apparatuses 7 may be installed at locations at which the transporting rails 3 and 4 are positioned closely to each other and wherein the transporting rail 4 may extend from the exit of the bobbin exchanging apparatus 7 over a distance greater than the overall length of the bobbin transporting carriers 9 before being terminated. In this case, the bobbin transporting carrier 8 travelling on and along the transporting rail 3 in the clockwise direction, as viewed in FIG. 19, to be transported into the bobbin exchanging apparatus 7 on one hand and the bobbin transporting carrier 9 travelling along the transporting rail 4 in the direction from the top toward the bottom, as viewed in the some figure, on the other hand, undergo the bobbin exchange operations sequentially in such a manner as described hereinbefore. Upon completion of the bobbin exchange operation, the bobbin transporting carrier 9 may be moved backwardly, passing through the bobbin exchanging apparatus 7 again. In that case, the succeeding bobbin transporting carrier 9 may be placed at the standby position located in front of the path along which the preceding bobbin transporting carrier 9 is fed out. With such arrangement, the transfer of the full bobbins FB and the empty bobbins EB can be realized between the bobbin transporting carriers 8 and 9, whereby advantageous effects as those of the embodiments described above can be achieved. As another modification, the bobbin transporting carrier 9 may be so transported as to once pass through the bobbin exchanging apparatus 7 to a position located at the side opposite to the spinning machine array R, and thereafter the bobbin transporting carrier 9 is again moved backwardly to thereby allow the full bobbins FB to be exchanged with the empty bobbins EB of the bobbin transporting carrier 8 which passes by the bobbin transporting carrier 9 in the opposite direction. Besides, only the transporting rail 3 may be terminated at one side of the bobbin exchanging apparatus 7 or alternatively both the transporting rails 3 and 4 may be terminated at one side of the bobbin exchanging apparatus 7.

(2) In the case of the bobbin transporting system according to the second embodiment of the invention, the flyer frames 1 are classified into groups for every same type of the roving bobbins. In this conjunction, such arrangement may equally be adopted in which the preset pitches of the bobbin transporting carriers 9 in the bobbin exchanging apparatus 7 may be varied from one to another group of the machines, so that the bobbin transporting carriers 9 having different bobbin hanger pitches for different types of spinning machines, respectively, may coexist on the transporting rail 4.

(3) The number of the bobbin hangers 10 of the bobbin transporting carriers 8 and g may also be changed. By way of example, the number of the bobbin hangers 10 may be same for both the bobbin transporting carriers 8 and 9. On the contrary, three or four times as large as the number of the bobbin hangers 10 of the bobbin transporting carrier 8 may be provided for the bobbin transporting carrier 9. With this arrangement, the overall length of the bobbin transporting carrier 9 increases, which in turn allows the interval at which the transfer apparatuses 14, 14*a* installed on the transporting rail 4 to be increased correspondingly, whereby the number of the feeding apparatuses 14, 14*a* installed in association with the transporting rail 4 can be correspondingly decreased, to an advantage.

(4) The bobbin transporting system may be implemented in combination with the spinning machines and the flyer frames 1 in which the number of the bobbins in the spinning machine is not equal to an integral multiple of the bobbins in the flyer frame 1.

(5) Further, the bobbin transporting system may be provided in combination with the flyer frame array F and the spinning machine array R in which the flyer frames and spinning machines differing from one another in respect to the number of bobbins coexist, respectively, In that case, the bobbin transporting system may be so arranged that the bobbin transporting carriers 8 and 9 carrying different numbers of bobbins are controlled to travel on and along the same transporting rails 3 and 4, respectively. With this arrangement, some bobbins may remain not exchanged in the bobbin exchanging apparatus 7. However, such bobbin can be handled by the succeeding counterpart bobbin transporting carrier 8 or 9, providing thus no problem.

(6) The direction in which the flyer frames 1 and the spinning machines 2 are arrayed may be altered, as occasion requires. By way of example, such a layout can be conceived in which the flyer frame array F is oriented orthogonally to the spinning machine array R.

(7) Additionally, a plurality of bobbin exchange apparatuses 7 may be installed on one transporting rail 3 so that the bobbin exchanging apparatus can be carried out in parallel at a plurality of locations. By way of example, the transporting rail 4 may be extended to the right-hand side of the transporting rail 3, as indicated by a broken line in FIG. 19 and the bobbin exchanging apparatus 7 is additionally provided at the right-hand side of the transporting rail 3, as viewed in FIG. 19, wherein two bobbin transporting carriers 8 each carrying the full bobbins FB in suspension are transported into the bobbin exchange apparatuses 7 installed at left and right sides, respectively, so that the bobbin exchange operation can be carried out simultaneously in parallel in both the bobbin exchange apparatuses 7.

(8) Layout configuration of the transporting rail 3 is never limited to the closed loop path. By way of example, a right side section of the transporting rail 3, as viewed in FIG. 1, may be spared. In that case, the bobbin exchange can be carried out by reciprocatively feeding the bobbin transporting carrier 8 to the bobbin exchanging apparatus 7 on a one-by-one basis.

(9) An arrangement in which the bobbin transporting carriers 8 and 9 are moved by corresponding pulling machines may equally be adopted.

(10) The transfer apparatus equipped with a pair of rotatable disks such as disclosed in Japanese Unexamined Patent Application Publication No. 67368/1985 (JP-A -60-673678) may equally be made use of.

(11) In the bobbin transporting system according to the second embodiment of the invention, the number of the frames constituting one group is never limited to two. By way of example, the number of the frames may differ from one to another group. Besides, one group may be constituted by one frame.

Embodiment 3

Figure 20:
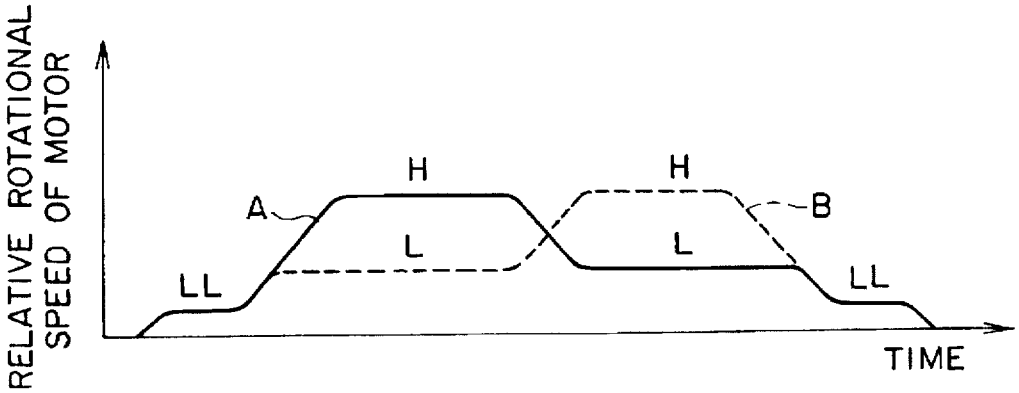
FIG. 20 is a view showing preset speed patterns for motors employed in a bobbin transfer mechanism of a bobbin transporting system according to another embodiment of the invention.

Next, referring to FIG. 20, description will be directed to another embodiment of the bobbin exchange apparatus according to the present invention.

The bobbin exchange apparatus according to the instant embodiment of the invention differs from that of the first embodiment in respect to the process for moving the full bobbins FB and the empty bobbins EB from the withdrawing position to the fitting or leading position after removal of the full bobbins FB and the empty bobbins EB from the bobbin hangers 10 of the bobbin transporting carriers 8 and 9. In the case of the bobbin exchange apparatus according to the first embodiment of the invention, the slide base apparatuses 52 to 55 and the feeding apparatus 14*a* are separately driven in accordance with a predetermined operation sequence. By contrast, in the bobbin exchange apparatus now under consideration, the slide base apparatuses 52 to 55 and the feeding apparatus 14*a* are concurrently driven in parallel.

FIG. 20 graphically shows the preset speeds of the motor 63 provided in association with the slide base apparatuses 52 to 55, respectively, and the motor 28 for the feeding apparatus 14*a* which are controlled by the control apparatus C. The preset speeds mentioned above are previously programmed and stored in the control apparatus C, whereby the speed control for the motors 28 and 63 are performed in accordance with the program which conform to the speed patterns shown in FIG. 20. In this figure, a solid line curve indicates the preset speed of the motor 63 while a broken line curve represents the preset speed for the motor 28.

Now, procedure for the transfer process will be elucidated.

At first, the reversible electric motor 63 is driven at a high speed (H) with the motor 28 being driven at a low speed (L). However, in the initial stage for starting these motors, a very low speed range LL is validated with a view to preventing the full bobbins FB and the empty bobbins EB from swinging. The base plate 57 and the bobbin transporting carriers 8 and 9 start to move, respectively. Because the base plates 57 move at a high speed (H) with the bobbin transporting carriers 8 and 9 moving at a low speed (L), the full bobbins FB and empty bobbins EB disposed above the base plates 57 are rapidly pulled out from the respective bobbin rows. Since the bobbin rows move slowly, the full bobbin FB will not interfere with other full bobbins FB in the same bobbin row.

Upon withdrawal of the bobbins FB and EB from the associated bobbin rows (e.g. to the intermediate stop position), the reversible electric motor 63 is decelerated to a low speed range L from the high speed range H, while the motor 28 is accelerated to the high speed range H from the low speed range L. Consequently, when the full bobbin FB is slowly placed in the destination bobbin row to be disposed at the loading position, the destination bobbin row moves rapidly so as to make available a space for the loading position. Thus, interference of full bobbins FB with those undergone the exchange operation is avoided. In that case, it is apparent that the empty bobbin EB of a smaller outer diameter can be disposed at the fitting or loading position thereof without interfering with other bobbins FB and EB. Immediately before the full bobbin FB and the empty bobbin EB are disposed at the respective fitting or mounting position, the motors 28 and 63 are decelerated to the very low speed range LL, whereby the full bobbin FB and the empty bobbin EB are prevented from swinging and interfering with the other bobbins, when the full bobbin FB and the empty bobbin EB are stopped at the respective fitting positions.

Because the feeding operation for the base plate 57 and the transfer operation for the bobbin transporting carriers 8 and 9 are concurrently carried out, the time taken for the bobbin transfer operation can be shortened, whereby the time taken for the bobbin exchange can further be shortened.

Furthermore, in the transfer process described above, the base plate 57 is moved smoothly from the withdrawing position to the fitting or loading position without being stopped on the way. Besides, because the base plate 57 and the bobbin transporting carriers 8 and 9 are simultaneously started and stopped, as if they were interlocked with each other, they provide a pleasing appearance.

The present invention is not restricted to the illustrated embodiments. Numerous modifications and combinations are possible without departing from the spirit and scope of the invention.

By way of example, following modifications may be made within the scope of the invention.

Figure 21:
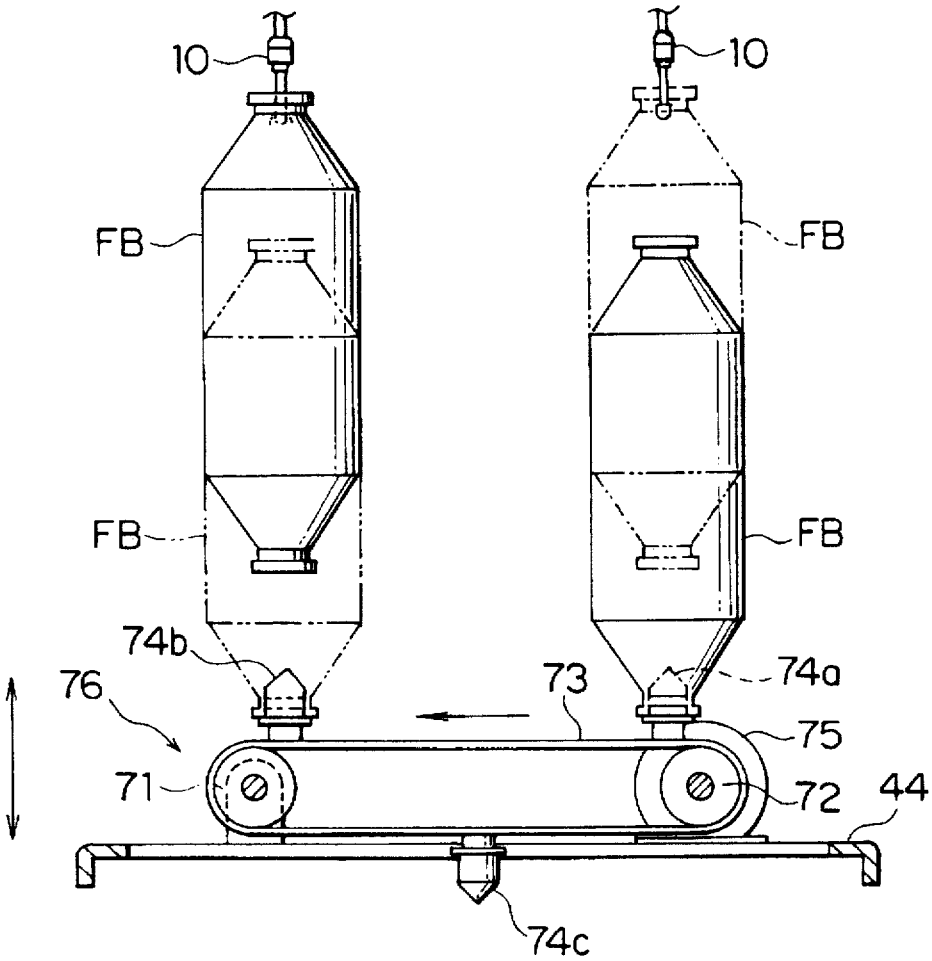
FIG. 21 is a side elevational view showing schematically a structure of a bobbin exchanging apparatus according to yet another embodiment of the invention.

(1) As is shown in FIG. 21, conveyor apparatuses 76 each of which is composed of an endless belt 73 spanned between a pair of pullies 71 and 72 and having three pegs 74*a*, 74*b* and 74*c* mounted fixedly on the outer surface with a distance therebetween which is equal to the distance between the withdrawing position and the fitting position is driven by a motor in the counterclockwise direction, as viewed in FIG. 21, may be disposed on the vertically movable table 44 in the same pattern as the slide base apparatus described hereinbefore in conjunction with the first and second embodiment. Owing to such arrangement, the peg lift/lower operation performed twice in one cycle for the withdrawal and the fitting or loading of the bobbins can be accomplished once, while rendering it unnecessary to move the peg 56 reciprocatively. More specifically, starting from the state in which the full bobbin FB is disposed immediately above the peg 74*a* located at the withdrawing position (right-hand side in FIG. 21) while the full bobbin FB is fit to the other peg 74*b* located at the fitting or loading position (left-hand side in FIG. 21) with the empty bobbin hanger 10 being disposed just above the second mentioned bobbin FB, as is shown in phantom in FIG. 21, the table is lifted and lowered once. Then, the bobbin FB disposed just above the peg 74*a* is fit onto the peg 74*a* to be thereby withdrawn, while the bobbin FB fit on the peg 74*b* is mounted onto the bobbin hanger 10. In this manner, with a single cycle of the table lifting/lowering operation, withdrawal of the bobbin FB disposed at the position for withdrawl and the loading of the bobbin FB located at the loading position can concurrently be performed. Subsequently, the motor 75 is driven to revolve the belt 73 for a predetermined distance in the clockwise direction. As a result of this, the bobbin FB fit on the peg 74*a* is displaced to the loading position from the withdrawing position, while the peg 74*c* located on the lower span of belt 73 is disposed at the withdrawing position. In the meanwhile, the feeding apparatus 14*a* is driven to advance the bobbin transporting carriers 8 and 9 in parallel to each other. Thus, the first state shown by broken lines is resumed. In succession, the cycle including only the single table up/down motion and the revolution of the belt 73 for a predetermined distance is repetitively carried out, whereby the bobbins are exchanged successively each by a predetermined number. In this way, the time taken for the bobbin exchange can significantly be reduced.

(2) The number of the bobbins to be exchanged during one cycle can be varied appropriately. By way of example, by disposing two slide base apparatuses, the bobbins may be exchanged one by one or alternatively the bobbins may be exchanged on a three-by-three basis by installing six slide base apparatuses.

(3) In the bobbin exchange station, the bobbin transporting rails need not extend in parallel with each other but they may be so disposed as spread outwardly or bent more or less, so long as both the bobbin carriers 8 and 9 can move in the directions opposite to each other. Further, the transporting rails 3 and 4 may differ from each other in respect to the height thereof. In that case, the peg up/down stroke may be made to be different for the withdrawing position and the fitting or loading position, respectively.

(4) The path along which the pegs 56 are moved during the transfer process is not limited to a linear path but may be bent or curved. By way of example, the pegs 56 may be provided on the base plate 57 so as to be movable in the direction widthwise of the housing 58, being guided by grooves curved in the longitudinal direction thereof. With this arrangement, the pegs 56 can be moved along a curved path with a simple structure.

(5) The pattern of disposition of the slide base apparatuses may appropriately be changed by taking into consideration the bobbin hanger pitches of both the bobbin transporting carriers 8 and 9, the diameter of the bobbins to be exchanged, the paths of the transporting rails 3 and 4 in the bobbin exchanging station.

(6) The slide base apparatus driven by means of the ball/screw mechanism may be replaced by a rodless cylinder (table cylinder) which includes a piston disposed within a cylinder and moved in response to difference in hydraulic (air) pressures within the chambers defined at both sides of the piston within the cylinder. In that case, magnets may be mounted on the piston of the rodless cylinder so that the pegs may move together with the piston under the magnetic attraction exerted by the magnets. Because the rodless cylinder is excellent in respect to the air tightness, degradation of movability thereof due to invasion of fly waste or the like can be evaded. Of course, by using an air cylinder equipped with a piston rod, the pegs may be moved linearly.

(7) The lift mechanism for the table 44 is not limited to the belt-type mechanism described hereinbefore in conjunction with the illustrated embodiments but a rack/pinion mechanism or a ball/screw mechanism may be adopted. In particular, the rack/pinion mechanism is preferred because the power transmission capability thereof can be prevented from degradation regardless of deposition of fly waste more or less on the movable parts thereof. Further, the table 44 may be lifted and lowered by using the cylinder.

(8) The up/down displacements of the pegs 56 may be realized without using the table 44. By way of example, upstanding cylinders having piston rods each having a peg secured fixedly at a tip end thereof may be installed on the base plates 57 of the slide base apparatuses 52 to 55, respectively.

(9) The bobbin exchanging apparatus 7 may be used in combination with a feeding apparatus in which the link member is held, being sandwiched between a pair of rotatable disks for imparting the thrust to the bobbin carrier.

(10) The up/down stroke of the peg 56 may be set longer than the bobbin length so that the table 44 can be lowered to the position at which the tops of the bobbins fit onto the pegs 56 are short of contact with the bottom ends of the bobbins FB suspended on the bobbin transporting carriers 8 and 9. With this arrangement, interference between the bobbins FB and EB transferred and those suspended can be put aside from consideration. Thus, the stop control of the pegs 56 in the transfer process (the first embodiment) and speed control (second embodiment) can be rendered unnecessary, whereby the control system can be implemented in a simplified structure, although the time taken for the up/down motion thereof may increase more or less.

(11) During the process for moving the pegs 56 and the bobbin transporting carriers 8 and 9, they may be moved at an equal speed. In that case, the control system can be realized in a much simplified structure with the time involved in the processes shortened. Although the bobbins may swing to some extent, there arises no obstacle to the withdrawal of the bobbins FB and EB.

(12) Without using the feeding apparatus, the bobbin carrier may be moved by a conveyor system for transporting the bobbins into the bobbin exchanging apparatus 7.

What is claimed is:

1. A bobbin transporting system, comprising:

a first group of bobbin transporting carriers for transporting bobbins at a first predetermined pitch;

first transporting rail means supporting said first group of bobbin transporting carriers for movement within an array of flyer frames;

a second group of bobbin transporting carriers for transporting bobbins at a second predetermined pitch different from said first pitch;

second transporting rail means separate from and independent of said first transporting rail means and supporting said second group of bobbin transporting carriers for movement independent of said first group of bobbin transporting carriers within an array of spinning machines, said first and second transporting rail means being laid out such that at at least one common location a section of said first transporting rail means is located adjacent, a predetermined distance from, a corresponding section of said second transporting rail means; and bobbin exchanging means installed at said common location straddling said respective sections of said first and second transporting rail means for exchanging between said first and second groups of bobbin transporting carriers bobbins being transported at said first pitch by said first group of bobbin transporting carriers with bobbins being transported at said second pitch by said second group of bobbin transporting carriers.

2. A bobbin transporting system according to claim 1, wherein said first transporting rail means is constituted by rail sections which are so interconnected that said first group of bobbin transporting carriers are supported for movement around all the flyer frames constituting said array of flyer frames.

3. A bobbin transporting system according to claim 1, wherein said array of flyer frames comprise a plurality of flyer frame groups; said first transporting rail means comprises an independently operative section of rail for each of said plurality of flyer frame groups, each of said independently operative sections of rail of said first transporting rail means has a portion disposed at a respective location adjacent and at said predetermined distance from a corresponding portion of said second transporting rail mains; and wherein a plurality of said bobbin exchanging means are provided one for each of said independently operative sections of rail at said respective location of adjacency straddling said corresponding portions of said first and second transporting rail means.

4. A bobbin transporting system according to claim 1, wherein at least one of said first and second transporting rail means includes a closed loop portion which extends through said bobbin exchanging means.

5. A bobbin transporting system according to claim 1, wherein each of said bobbin transporting carriers has a discrete overall length, further comprising a plurality of feeding apparatuses for imparting thrusts to said bobbin transporting carriers installed in association with each of said first and second transporting rail means at intervals that are shorter than said discrete overall lengths of said corresponding bobbin transporting carriers.

6. A bobbin transporting system according to claim 1, wherein said first transporting rail means is branched into two rail branches corresponding to the number of bobbin wheel rows at places where a doffing operation is performed, and wherein said first group of bobbin transporting carriers contains two bobbin transporting carriers with bobbin hangers for disposition rail branches such that said bobbin hangers are disposable in two zigzag rows corresponding to the pattern in which said bobbin wheels are disposed in said flyer frames.

7. A bobbin transporting system according to claim 1, wherein said bobbin transporting carriers are provided with bobbin hangers for receiving the bobbins, and said bobbin exchanging means includes:

transfer drive means including a plurality of retaining means for individually and selectively coupling to said bobbins and which are movable between a withdrawing position located within said bobbin exchanging means directly beneath a position where bobbins are to be removed from a bobbin carrier of said first group of bobbin transporting carriers and a loading position located within said bobbin exchanging means directly beneath a destination position at which there are disposed empty bobbin hangers on a counterpart bobbin carrier of said second group of bobbin transporting carriers from which the bobbins have been withdrawn during travel of the bobbin carriers of said first and second groups of bobbin transporting carriers in opposite directions through a pitch distance substantially equal to the distance spanned by the number of bobbins to be exchanged at any one time so that the succeeding bobbins to be exchanged are positioned just above said withdrawing position, wherein said retaining means corresponding to the bobbins to be exchanged at any one time are moved on respective paths interconnecting said withdrawing position and said loading position; and lift means for executing a stroke for lifting and lowering said retaining means at said withdrawing position and said loading position, respectively, between a lifted position at which the bobbins to be exchanged are engaged by a retaining means for withdrawal from the bobbin hangers of the bobbin carriers of said first group of bobbin transporting carriers, and previously withdrawn bobbins are coupled to bobbin hangers of bobbin carriers of said second group of bobbin transporting carriers, and a lowered position at which the tops of the bobbins engaged by said retaining means are displaced downwards away from the associated bobbin hangers of said bobbin carriers of said first group of bobbin transporting carriers, and at which said retaining means are incapable of engaging bobbins suspended from said bobbin transporting carriers.

8. A bobbin transporting system according to claim 7, further comprising:

an endless conveyer member spanned between a pair of pullies disposed with a distance therebetween which is greater than the distance between said withdrawing position and said loading position, and wherein at least three retaining means are provided on an outer peripheral surface of said endless conveyor member with equal distance therebetween, said equal distance corresponding to the distance between said withdrawing position and said loading position, said endless conveyor member being revolved by said transfer drive means in one direction in which said retaining means move from said withdrawing position toward said loading position.

9. A bobbin transporting system according to claim 7, wherein said bobbin exchanging apparatus includes a number of said retaining means for exchanging full bobbins suspended from the bobbin transporting carrier running on said first transporting rail means with empty bobbins suspended from the bobbin transporting carrier running on said second transporting rail means, and wherein said paths along which said retaining means for transferring said bobbins from said first to said second group of carriers are moved, are respectively inclined substantially equally relative to a center line extending orthogonally to the path along which said bobbin transporting carriers travel.

10. bobbin transporting system according to claim 7, further comprising:

feeding means provided in association with said transporting rail means for imparting a propelling thrust to said bobbin transporting carriers while said carriers are traveling through said bobbin exchanging means; and control means for controlling said feeding means, said transfer drive means and means for driving said lift means, said control means being constructed and arranged to stop said feeding means when the bobbins suspended at a leading side of said bobbin transporting carrier that is being transported into said bobbin exchanging means under thrust exerted by said feeding means are positioned immediately above respective withdrawing positions, to actuate said lift driving means for lifting and lowering once said retaining means when the latter is disposed at said withdrawing position, to actuate said transfer drive means for moving said retaining means from said respective withdrawing positions to said respective loading positions when said retaining means is again disposed at the lowered position after said lifting operation, to drive said feeding means to thereby move said bobbin transporting carriers so that the bobbins to be next exchanged are disposed immediately above said withdrawing positions, and to actuate said lift driving means for lifting and lowering once said retaining means when said retaining means are disposed at said loading positions and when the bobbins to be next exchanged are disposed at said withdrawing positions, and repeating the operation cycle after returning said retaining means to said withdrawing positions.

11. A bobbin transporting system according to claim 10, wherein the lowered position of said lift means positions the tops of the bobbins that are on said retailing means at a level that is above the bottoms of the bobbins suspended from said transporting carriers, and said control means controls said transfer drive means and said means for driving said lift means such that, when said lift means is at its lowered position and said bobbins are being transferred by said transfer means, bobbins on said retaining means do not collide with bobbins suspended from said bobbin transporting carriers.

12. A bobbin transporting system according to claim 11, wherein during the process for moving said retaining means from said withdrawing position to said loading position, said control means controls the speed of said transfer drive means and said feeding means moving said retaining means at a first speed while said bobbin transporting carrier is moved at a second speed during the withdrawal of bobbins from said first group of bobbin transporting carriers, and said retaining means is moved at said second speed while said bobbin transporting carrier is moved at said first speed during the loading of said bobbins on said second group of bobbin transporting carriers, said first speed being higher than said second speed, thereby enabling operation of said transfer drive means and said feeding means to be started and stopped simultaneously.

13. A bobbin transporting system according to claim 1, wherein said second transporting rail means includes a closed loop path extending through said bobbin exchanging means, said system further comprising:

residual roving eliminating means disposed along an intermediate section of said second transporting rail means which extends from said array of spinning machines to said bobbin exchanging means for eliminating residual rovings from empty bobbins suspended from said second group of bobbin transporting carriers traveling in said intermediate section of said second transporting rail means.

14. A bobbin transporting system according to claim 1, wherein said second transporting rail means is branched into a first plurality of parallel transporting rail branches at a position preceding the location where the bobbin carriers of said second group of bobbin transporting carriers are transported into said bobbin exchanging means, said first plurality of transporting rail branches constituting a standby place for said bobbin transporting carriers of said second group.

15. A bobbin transporting system according to claim 14, wherein a section of said second transporting rail means onto which said bobbin transporting carriers of said second group are fed from said bobbin exchanging means is branched into a second plurality of parallel transporting rail branches, said second plurality of rail branches constituting a stock place for said bobbin transporting carriers of said second group.

16. A bobbin transporting system according to claim 1, wherein the bobbins are mounted suspended from bobbin hangers provided on said bobbin transporting carriers running on said first and second transporting rail means, said bobbin hangers being suspended from said bobbin transporting carriers at said first and second pitches, respectively, wherein said exchanging means includes means for exchanging at one time a predetermined number of full bobbins and empty bobbins upon every exchanging operation thereof while moving intermittently said bobbin transporting carriers oppositely in the respective traveling directions.

* * * * *

UNITED STATES PATENT AND TRADEMARK OFFICE

CERTIFICATE OF CORRECTION

PATENT NO. : 5,715,669

DATED : February 10, 1998

INVENTOR(S) : T. Hasegawa et al.

It is certified that error appears in the above-indentified patent and that said Letters Patent is hereby corrected as shown below:

Abstract, line 1, change "are" to --has an--;
line 3, after "machines" delete "are";
line 6, after "that of" insert --the--.

Column 4, line 47, change "rove" to --roving--.

Column 8, line 13, after "position" change the period "." to a comma --,--;
line 24, after "position" change the period "." to a comma --,--.

Column 10, line 35, after "respectively" change the period "." to a comma --,--.

Column 11, line 14, after "rail" insert --4,--.

Column 15, line 36, after "the" (first occurrence) delete "a".

Column 22, line 23, after "50" insert a comma --,--.

Column 24, line 4, after "pegs" insert --56,--.
line 59, before "basis" delete "two".

Column 25, line 33, after "junction" insert a comma --,--.

Column 26, line 8, after "simplified" insert a comma --,-.
line 64, change "tan" to --can--.

UNITED STATES PATENT AND TRADEMARK OFFICE

CERTIFICATE OF CORRECTION

PATENT NO. : 5,715,669

DATED : February 10, 1998

INVENTOR(S) : T. Hasegawa et al.

It is certified that error appears in the above-indentified patent and that said Letters Patent is hereby corrected as shown below:

Column 30, line 40, change "g" to --9--.

Column 31, line 54, change "leading" to --loading--.

Column 35, line 60, after "disposition" insert --on said--.

Column 36, line 66, before "bobbin" insert --A--.

Signed and Sealed this

FourthDay of August, 1998

Bruce Lehman

*Attest:*

BRUCE LEHMAN

*Attesting Officer*

*Commissioner of Patents and Trademarks*